US005914572A

United States Patent [19]

Qian et al.

[11] Patent Number: 5,914,572

[45] Date of Patent: Jun. 22, 1999

[54] DISCHARGE LAMP DRIVING CIRCUIT HAVING RESONANT CIRCUIT DEFINING TWO RESONANCE MODES

[75] Inventors: Jinrong Qian, Croton-On-Hudson, N.Y.; Fred C. Lee, Blacksburg, Va.; Tokushi Yamauchi, Hirakata, Japan

[73] Assignees: Matsushita Electric Works, Ltd., Osaka, Japan; Virginia Tech Intellectual Properties, Inc., Blacksburg, Va.

[21] Appl. No.: 08/878,821

[22] Filed: Jun. 19, 1997

[51] Int. Cl.[6] ..... H05B 37/02

[52] U.S. Cl. ..... 315/307; 315/209 R; 315/DIG. 4; 315/DIG. 7

[58] Field of Search ..... 315/307, 209 R, 315/224, DIG. 4, DIG. 7, 219, 246, 226, 200 R

[56] References Cited

U.S. PATENT DOCUMENTS 5,371,440 12/1994 Liu et al. ..... 315/209 R

*Primary Examiner*—Don Wong
*Assistant Examiner*—David H. Vu
*Attorney, Agent, or Firm*—Nikaido, Marmelstein, Murray & Oram LLP

[57] ABSTRACT

An improved discharge lamp driving circuit of a charge-pump type capable of suppressing a ripple in an envelop of a lamp current at the time of dimming the lamp or at a low environmental temperature. The circuit includes an inverter having switching elements Q1 and Q2 for converting a voltage across a smoothing capacitor Ce into a high frequency power which is applied through a resonant circuit to the discharge lamp Ld. A capacitor Cin is connected to one end of the resonant circuit to vary a DC voltage of the output of the rectifier in accordance with a varying instantaneous value of the high frequency current or voltage appearing in the resonant circuit. A control circuit is provided to give a control signal for alternately turning on and off the switching elements Q1 and Q2. A feedback circuit FB is provided to modulate the control signal within a permissible range given to the control circuit in such a manner as to adjust the timing of turning on and off the switching elements Q1 and Q2 in a feedback manner based upon a lamp current detected by a current sensor SI, for reducing the ripple in the lamp current. A mixer MX is included to compensate for the lamp current in consideration of a dimmer signal Dim of dimming the lamp in order to suppress the ripple which would otherwise increase due to the dimming of the lamp.

9 Claims, 28 Drawing Sheets

①
②

DISCHARGE LAMP DRIVING CIRCUIT HAVING RESONANT CIRCUIT DEFINING TWO RESONANCE MODES

BACKGROUND OF THE INVENTION

1. Field of the Invention

The present invention is directed to a discharge lamp driving circuit for operating a discharge lamp by a high frequency alternating current converted from a low frequency alternating current source such as AC mains.

2. Description of the Prior Art

There has been provided a discharge lamp driving circuit for operating a discharge lamp by a high frequency alternating current. Such driving circuit is required to suppress an input current distortion as well as to maintain a high input power factor. For achieving a high power factor, various circuits have been proposed to include a step-up chopper for conversion of an AC voltage source into a DC voltage source and an inverter for conversion of a DC current from the DC voltage source into a high frequency AC current being fed to operate the discharge lamp.

However, such lamp driving circuit having the two-stage conversions at the chopper and the inverter necessitates a relatively large number of electric components, increasing the bulk and cost of the circuit. In order to reduce the bulk and cost, there have been also proposed discharge lamp driving circuits of various configurations.

Japanese Patent Early Publication (KOKAI) No. 4-193067 proposes a circuit having a circuit configuration of FIG. 21 of the attached drawings which is equivalent to that shown in FIG. 6 of the publication. In this circuit, a series combination of diodes D1, D2 and a smoothing capacitor Ce is connected across a full-wave rectifier diode bridge DB to provide a DC power source from an alternating voltage source AC. A series combination of switching elements Q1 and Q2 is connected across the smoothing capacitor Ce. Another series combination of a DC current blocking capacitor Cc, an inductor Lrs, and a capacitor Crs is connected across the one switching element Q2, while a discharge lamp Ld is connected across the capacitor Crs as a load. The switching elements Q1 and Q2 are cooperative with capacitor Cc to form the inverter of a half-bridge configuration and are controlled by a controller (not shown) to alternately turn on and off at a high frequency sufficiently higher than the frequency of the AC power source. MOSFET is utilized as the switching elements Q1 and Q2. Thus configured inverter operates to convert a DC voltage across the smoothing capacitor Ce into the high frequency electric power which is then fed to the discharge lamp Ld through a resonant circuit of capacitor Crs and inductor Lrs. In order to suppress an input current distortion for keeping a high input power factor, a capacitor Cin in included in a path between an output of the inverter (connection of inductor Lrs to capacitor Crs) and a point between diodes D1 and D2.

Now considering a transient operation in a short time (i.e., corresponding roughly to one switching cycle of switching elements Q1 and Q2) of the circuit of FIG. 21, the circuit can be represented as shown in FIG. 22 in which output voltage Vg of rectifier DB is connected to the anode of diode D1, a DC source voltage Vdc is connected to the cathode of diode D2, and a high frequency source voltage Va is connected through a capacitor Cin to a point between diodes D1 and D2. Since the rectifier DB is assumed to give a constant output voltage Vg within one cycle of the high frequency voltage Va, a constant voltage Vdc is developed across smoothing capacitor Ce. In the following description, voltage Va being applied to the discharge lamp is explained to have a amplitude Vp.

The operation of the above circuit can be explained through four successive stages as shown in FIGS. 23A to 23D. FIG. 23A illustrates an operation at one of four stages corresponding a period ① of FIG. 24 in which voltage Va decreases from a positive peak Vp. In this stage, diodes D1 and D2 are both made non-conductive so that capacitor Cin does not discharge to maintain a voltage Vc across capacitor Cin at a minimum voltage Vc.min. FIG. 24 illustrates a charge-discharge current Cin flowing into and from capacitor Cin. Minimum voltage Vc.min within one cycle of voltage Va corresponds to a difference between voltages Vd and Vp. In this period ① where capacitor Cin provides a constant voltage, voltage Vb at the connection between diodes D1 and D2 decreases with a decreasing voltage Va. The period ① continues until voltage Vb at the connection between diodes D1 and D2 decreases to voltage Vg (=Va+Vc.min).

When voltage Vb becomes equal to Vg (=Va+Vc.min), diode D1 is made conductive, as shown in FIG. 23B, to start a period ② of FIG. 24 where capacitor Cin receives a charging current Ic. Since the voltage source AC has only low impedance, i.e., sufficiently large current capacity, voltage Vb at the connection between diodes D1 and D2 is maintained at Vg, as shown in FIG. 24. That is, voltage Vc across capacitor Cin will increase as voltage Va decreases. When voltage Va reaches a negative peak voltage—Vp, no charge current Ic flows into capacitor Cin to thereby make diode D1 non-conductive, thereby terminating the period ②. At this occurrence, voltage Vc across capacitor Cin increases to a maximum voltage Vc.max within one cycle of voltage Va.

In the subsequent period ③, voltage Va will increase from the negative peak voltage—Vp, as shown in FIG. 24. In this period, diodes D1 and D2 are made both non-conductive, as shown in FIG. 23C, so that capacitor Cin will not discharge to maintain voltage Vc across capacitor Cin constant at a maximum voltage Vc.max, as shown in FIG. 24. That is, voltage Vb between diodes D1 and D2 will increase with the increasing voltage Va. The period ③ will last until voltage Vb is made equal to voltage Vdc (=Va+Vc.max).

When voltage Vb becomes equal to voltage Vdc (=Va+Vc.max), a period ④ appears to make diode D2 conductive, as shown in FIG. 23D.

In this period ④, a discharge current Ic will flow from capacitor Cin through diode D2, as shown in FIG. 24. Since the smoothing capacitor Ce has a sufficiently low impedance (or great capacity), voltage Vb between diodes D1 and D2 is kept at voltage Vdc. That is, as voltage Va increases as shown in FIG. 24, voltage Vc across capacitor Cin will decrease. When voltage Va reaches the positive peak Vp, no further discharge current Ic flows to make diode D2 non-conductive, terminating the period ④. At this occurrence, voltage Vc across capacitor Cin decreases to the negative peak voltage Vc.min so that the period ① takes over.

As described in the above, the periods ① to ④ repeat as a consequence of the switching elements Q1 and Q2 being turned on and off, and an input current is fed from the voltage source AC in the period ②. Thus, the voltage source AC can supply a high frequency current while the switching elements Q1 and Q2 are turned on and off such that the provision of high frequency blocking filter between the source AC and rectifier DB enables to continuously flow the input current from the volage source AC for suppressing the input current distortion. Also as is clear from the above operation, the length of each of periods ① to ④ will vary depending upon the level of the input voltage Vg. For example, while the input voltage Vg is maintained at its peak value (i.e., Vg=Vdc), periods ① and ③ do not appear so that the length of each period ② and ④ becomes maximum corresponding to half cycle of voltage Va. As such, the input current will flow in an amount nearly proportional to an absolute value of voltage Vb for maintaining the input power factor at a high level. It is noted here that the forward bias voltage drop of diodes D1 and D2 is neglected in the above explanation, and that resistor R in FIGS. 23A–23D corresponds to the inverter and resonant circuit.

Operation of the resonant circuit as a load of the inverter in the circuit of FIG. 21 will be now discussed. In periods ① and ③ where diodes D1 and D2 are both made non-conductive, capacitor Cin is excluded from the load of the inverter so that the circuit can be understood as an equivalent circuit of FIG. 25A. Capacitor Cc is selected to be of sufficiently high capacitance not to influence upon a resonant frequency of the resonant circuit. The resonant frequency in these periods is therefore determined by inductor Lrs and capacitor Crs. In periods ② and ④, one of diodes D1 and D2 is made conductive so that capacitor Cin becomes an additional factor of determining the resonant frequency so that the circuit can be understood as an equivalent circuit of FIG. 25B. Thus, the resonant frequency in these periods is determined by a parallel combination of capacitors Crs and Cin plus inductor Lrs. In this manner, the resonant circuit changes its configuration (hereinafter referred to as resonant mode) within one cycle of voltage Va. Also, as explained in the above, since the length of the periods ① to ④ will vary in accordance with an instantaneous value of input voltage Vg, an envelop of the lamp current flowing through the discharge lamp Ld within one voltage cycle of the voltage source AC will vary in accordance with the instantaneous value of input voltage Vg. In this consequence, there appears increased ripple and crest factor in the envelop, resulting in undesired fluctuation of light output with associated flickering.

In order to avoid the above problem, U.S. Pat. No. 5,410,466 having the same basic circuit configuration as mentioned in the above proposes to add a control scheme for controlling the operating frequency of the switching elements Q1 and Q2 and duty ratio thereof in order to suppress the crest factor of the lamp current. However, this scheme is designed to suppress the crest factor of the lamp current only during the normal steady-state lamp lighting operation, and cannot do so during a dimmer operation of dimming the lamp for the following reason.

FIG. 26 illustrates individual characteristic curves of output gain at the different resonant modes in the above periods ① ③ and ② ④ in which (a) is for indicating the characteristic curve obtained in the periods ② ④ at the dimmer operation, (b) for the curve obtained in the periods ① ③ at the dimmer operation, (c) for the a curve obtained in the periods ② ④ at the normal lighting operation, and (d) for the curve obtained in the periods ① ③ at the normal lighting operation. A switching frequency can be selected to be $f0$ where curve (c) crosses with curve (d) so as to turn on and off the switching elements Q1 and Q2 for the normal lighting operation of the lamp. Thus selected switching frequency can therefore reduce the variation in the output current due to the changing resonant modes, thereby enabling to suppress the ripples in the lamp current during the normal lighting operation.

A frequency control could be adapted in the above lamp driving circuit including the resonant circuit to vary the switching frequency of the elements Q1 and Q2 in accordance with the input voltage. A control signal utilized in this frequency control has a varying frequency of which bandwidth (i.e., modulation width) is dependent upon the amplitude of the input voltage. Since the amplitude of the input voltage is nearly constant, the modulation width is also kept nearly constant. Therefore, the frequency control is found effective to reduce the ripples and crest factor of the lamp current during the normal lighting operation.

Discussion is made to the dimmer operation which is effected by varying the switching frequency of switching elements Q1 and Q2. For example, when making the dimmer operation by shifting the switching frequency to $f1$ higher than that for the normal lighting operation, there appears a large difference between the output gain (indicated by ■ in FIG. 26) during periods ② ④ and the output gain (indicated by □ in FIG. 26) during periods ① ③, resulting in a correspondingly large difference in the output current between at the zero-cross point and peak of the input voltage. Even if the above frequency control is added, the modulation width is held constant irrespective of a varying dimming extent. Therefore, the crest factor of the output current is not expected to be improved, and even the operating life of discharge lamp Ld is considerably shortened when making the dimmer operation.

Alternately, a duty control may be utilized to vary a duty ratio of switching elements Q1 and Q2 instead of the switching frequency for effecting the dimmer operation. This control is made at a fixed switching frequency but is accompanied with varying equivalent impedance of the discharge lamp Ld. Consequently, there also appears a large difference between the output gain (indicated by Δ in FIG. 26) during periods ② ④ and the output gain (indicated by ▲ in FIG. 26) during periods ① ③, resulting in a correspondingly large difference in the output current between at the zero-cross point and peak of the input voltage. The duty control can be also combined with the above frequency control. However, since the modulation width is held constant irrespective of a varying dimming extent, the crest factor of the output current is not expected to be improved, and even the life of discharge lamp Ld is shortened when making the dimmer operation.

In short, the dimming of the discharge lamp either by the frequency control or duty control results in the increased ripples and crest factor to thereby shorten the life of the discharge lamp.

In the meanwhile, it is known that the discharge lamp will vary its equivalent impedance with a varying environmental temperature. Also when dimming the lamp, the equivalent impedance will increase with a correspondingly reduced lamp current. The increased impedance acts to enlarge the difference between the output gains of the two resonant modes within one cycle of the switching elements Q1 and Q2, thereby further increasing the low frequency ripple. Therefore, when dimming the lamp at a low environmental temperature, the discharge may become unstable to show undesired flickering, stripe shifting, or even lamp extinction . Consequently, the dimming of the lamp may shorten the lamp life and even causes the flickering, or the like undesired phenomena at the low environmental temperature.

FIG. 27 illustrates another prior art discharge lamp driving circuit in which discharge lamp Ld and capacitor Crs are connected across the series combination of switching element Q1 and diode D2, in contrast to the circuit of FIG. 21 in which discharge lamp Ld and capacitor Crs is connected across switching element Q2. Further, capacitor Cim is connected in parallel with diode D2 instead of capacitor Cin in the circuit of FIG. 21 for suppressing input current distortion and maintaining high input power factor. The circuit configuration of FIG. 27 can be expressed as an equivalent circuit of FIG. 28 in which an inverter is recognized to form a high frequency power source providing a current of constant amplitude.

The operation of the circuit of FIG. 28 can be explained in terms of four successive stages within one cycle of output current Ia from the high frequency power source, as is made for the circuit of FIG. 22. When the source voltage Vg is at its peak (i.e., Vg=Vdc), diode D1 is kept conductive over a maximum period within one cycle of the output current Ia, corresponding to one half cycle of the switching elements Q1 and Q2.

In the above circuit configuration, a resonant circuit is established by a series combination of inductor Lrs, capacitor Crs, and capacitor Cim while diodes D1 and D2 are both non-conductive. When diode D2 becomes conductive, capacitor Cim is shunted so that a resonant circuit is established by a series combination of inductor Lrs and capacitor Crs. Thus, this circuit has also two resonant modes within one switching cycle of switching elements Q1 and Q2, as is seen in the circuit of FIG. 21, and therefore gives rise to the same problem that the envelop of the lamp current will vary with the input voltage Vg to have increased ripples with attendant increase in the crest factor, thereby shortening the lamp life.

It has been also proposed in U.S. Pat. No. 5,404,082 and No. 5,410,221 to control the switching frequency of the switching elements Q1 and Q2 in the circuit of the like configuration for reducing the crest factor of the lamp current. The control is made to detect the input voltage, output voltage and lamp current so as to vary the switching frequency in accordance with detected parameters for reducing the crest factor of the lamp current. However, this prior art circuit is found to suffer also from increased crest factor at the time of dimming the lamp.

That is, the circuit of U.S. Pat. No. 5,404,082 operates to control the switching frequency based upon the detected input voltage, and suffers from varying ripple and crest factor with varying extent of dimming the lamp, as explained hereinbefore with reference to FIG. 26.

The circuit of U.S. Pat. No. 5,410,221 is designed to vary the switching frequency based upon the detected output voltage to the discharge lamp Ld for reducing the crest factor. In this circuit, a control is made to give a constant ratio between amplitude of variation in the lamp current and modulation width of the frequency of the switching elements Q1 and Q2. When dimming the lamp with the use of thus configured circuit, the ripple will become greater while the lamp current is made small. Therefore, the control signal is unable to give a modulation width wide enough to remove the ripple, eventually failing to reduce the ripple to a satisfactory extent at the time of dimming the lamp and suffering from increased power factor, thereby leading to unstable light output and shortening of the lamp life.

A further prior art circuit has been proposed by the inventors of the present application in the paper entitled "An Improved Charge Pump Electronic Ballast with Low THD and Low Crest factor" published by IEEE APEC '96 Conference Proceedings, pp. 622–627, 1996. As shown in FIG. 29, the circuit comprises a full-wave rectifier DB composed of a diode bridge for full-wave rectification of an alternating current voltage source AC such as AC mains, a smoothing capacitor Ce connected through a diode D2 across the outputs of the rectifier DB, and a pair of switching elements Q1 and Q2 connected in series across the smoothing capacitor Ce. A series combination of an inductor Lrs and capacitor Crs is connected across switching element Q2 on negative terminal side of smoothing capacitor Ce. A series combination of an inductor L2 and a capacitor C2 is connected across capacitor Crs through a DC blocking capacitor Cc. A discharge lamp Ld is connected across capacitor C2. Also, a diode $D_{C1}$ connected between one end of inductor Lrs adjacent to capacitor Crs and the anode of diode D2. Further, a diode $D_{C1}$ is connected between one end of inductor Lrs adjacent capacitor Crs and the cathode of diode D2 with the cathode of diode $D_{C1}$ connected to cathode of diode D2. Connected across capacitor Crs is a diode $D_{C2}$ having its anode connected to negative terminal side of the rectifier DB. With this configuration, the circuit has two resonant circuits, one composed of inductor Lrs and Crs and the other of inductor L2 and capacitor C2.

The circuit of FIG. 29 prevents smoothing capacitor Ce from having increased voltage Vdc at a light load operating condition such as pre-heating or starting-up of the lamp, thereby avoiding undue voltage stress which would otherwise applied to circuit components. Diodes $D_{C1}$ and DC2 are provided to suppress the crest factor. Diodes $D_{C1}$ and $D_{C2}$ act to clamp the peak-to-peak voltage across capacitor Crs to voltage Vdc across smoothing capacitor Crs to keep voltage across capacitor Crs clamped at voltage Vdc across smoothing capacitor Ce. Thus, the input voltage to the resonant circuit of inductor L2 and capacitor C2 is made to have a constant amplitude, thereby reducing ripple and therefore crest factor of the lamp current being fed to the discharge lamp Ld. Also because of that the peak-to-peak voltage across capacitor Crs is restricted to voltage Vdc of smoothing capacitor Ce, the envelop of the voltage being applied to capacitor Cin takes a sinusoidal form in conformity with the input voltage, thereby reducing input current distortion. This is confirmed from waveform comparison between FIGS. 30A, 30B in which diode $D_{C1}$ and $D_{C2}$ are eliminated and FIGS. 31A, 31B in which diodes are included. FIG. 30A and FIG. 31A show waveforms of voltage across capacitor Crs, while FIG. 30B and FIG. 31B show waveforms of voltage across capacitor Cin. In these figures, Vdc and Vg indicate voltage across smoothing capacitor Ce and output voltage of rectifier DB, respectively.

As explained in the above, the circuit of FIG. 29 is contemplated to suppress the crest factor of the lamp current without relying upon the frequency control of the switching elements Q1 and Q2. However, when dimming the lamp by a duty control of varying duty ratio of switching elements, there appears the following problem. The duty control is made to give the normal lighting operation at the duty ratio of 50%, i.e., at 1:1 ratio between ON-time duration of switching element Q1 and that of switching element Q2, and to give the dimming operation at a varying ON-time ratio between switching elements Q1 and Q2. For example, when the ON-time ratio is 7:3 between switching elements Q1 and Q2, voltage variation across capacitor Crs is reduced in its amplitude to thereby reduce the current flowing through capacitor Cin from voltage source AC, thereby lowering both the input from voltage source AC and output voltage to the discharge lamp Ld and maintaining a constant voltage Vdc across smoothing capacitor Ce.

However, the dimming of the lamp involves the reduction of voltage across capacitor Crs, while voltage Vdc across smoothing capacitor Ce is kept constant. This means that voltage across capacitor Crs is not clamped, thereby increasing the crest value of voltage across capacitor Crs being fed as input voltage to the resonant circuit of inductor L2 and capacitor C2 and therefore increasing the crest factor of the lamp current being fed to the discharge lamp Ld.

In order to suppress the crest factor of the lamp current, a modification may be conceived as shown in FIG. 32 in which a current sensor SI in the form of a current transformer is provided to detect the lamp current and a control is made to vary the operating frequency of the switching elements Q1 and Q2 based upon the detected lamp current. For this purpose, a feedback circuit FB is provided to include an error amplifier Amp and an delay circuit of resistor R1, diode Da, and capacitor Cd. The lamp current detected at the current sensor SI is converted into a corresponding voltage by means of resistor Rd, and is then processed in the delay circuit to give the ripple in an envelop of the lamp current which is compared with a reference voltage Vref to give a resulting error therebetween to a control circuit CN. The control circuit CN responds to vary the frequency of a control signal from the control circuit CN in a direction of eliminating the error. With this configuration, the lamp current can have a reduced crest factor at the rated lamp lighting.

However, when intended to apply a dimmer signal Dim to the control circuit CN for dimming the lamp, as shown in FIG. 33, there appears a problem that the crest factor of the lamp current will increase. This is because that the dimming of the lamp reduces the lamp current to correspondingly reduce the current fed to the feedback circuit FB. As discussed hereinbefore, voltage across capacitor Crs is not effectively clamped by diodes $D_{C1}$ and $D_{C2}$ while dimming the lamp so that only small output of the feedback circuit FB is available while the lamp current sees a large variation. Consequently, such lamp current of reduced level but of large variation is insufficient to modulate the control signal in a predetermined range given to the control circuit CN, thus failing to compensate for the large variation in the lamp current and therefore failing to reduce the crest factor successfully.

Notwithstanding that the above prior art discharge lamp driving circuit of a charge-pump type in which capacitors Cin and Cim are interposed in a charging path between the output of the inverter and smoothing capacitor can reduce the ripple and the crest factor of the lamp factor in the normal lighting operation, the circuit had to suffer from increased ripple and crest factor when dimming the lamp. In addition, the lamp current will suffer from a large variation at a low environmental temperature to bring about the undesired flickering.

SUMMARY OF THE INVENTION

The present invention has been accomplished in view of the above problems and has a primary object of providing a discharge lamp driving circuit which is capable of suppressing the ripple and crest factor of the envelop of the lamp current even at the time of dimming the lamp and at the low environmental temperature. The discharge lamp driving circuit of the present invention comprises a rectifier for rectifying an AC voltage from an AC voltage source to give a DC voltage, a smoothing capacitor for smoothing the DC voltage from the rectifier into a smoothed DC voltage, and an inverter including a switching element turning on and off at a high frequency for converting the smoothed DC voltage to provide a high frequency electric power. A control circuit is provided to give a control signal for turning on and off the switching elements to operate the inverter. The inverter is connected to a load circuit including a discharge lamp and a resonant circuit for applying the high frequency electric power to the discharge lamp through the resonant circuit. A capacitor is connected to one end of the resonant circuit for varying the DC voltage from the rectifier in accordance with a varying instantaneous value of the high frequency current or voltage appearing in the resonant circuit. The resonant circuit defines two resonance modes one including the capacitor and the other excluding the capacitor, and changes the resonance modes from one to the other within one switching cycle of the switching element, the one resonance mode lasting over a varying period relative to the period of the other resonance mode in accordance with an instantaneous voltage level of the AC voltage source. A ripple reducing circuit is included to provide a modulation signal which modulates the control signal to vary a timing of turning on and off the switching element within a certain range given to the control circuit in a direction of reducing ripples in an envelop of a lamp current being fed to the discharge lamp. In addition, a conditional signal generating means is included to generate a conditional signal indicative of an external condition affecting the increase of the ripple of the lamp current. Further, the ripple reducing circuit is configured to includes offset means which modifies the modulation signal in consideration of the conditional signal such that the modulation signal can modulate the control signal to vary the timing of turning on an off the switching element within the above range for reducing the otherwise increasing ripple. With the provision of the offset means, it is made possible to compensate for the external condition which affects to increase the ripple in the envelop of the lamp current, as in the case of dimming the lamp or operating the lamp at a low environmental temperature. The compensation is made by varying the timing of turning on and off the switching element depending upon the external condition represented by the conditional signal so as to suppress the ripple and crest factor.

Accordingly, it is a primary object of the present invention to provide a discharge lamp driving circuit which is capable of suppressing the crest factor even at the time of dimming the lamp and at the low temperature environment for stable lamp operation over a long period of life.

In preferred embodiments, the ripple reducing circuit comprises a detector for detecting at least one of an input voltage to the inverter and a load output from the inverter, and means for varying a factor of an input to an output of the detector according to the conditional signal. The input voltage to the inverter may be an input current to the rectifier, an input voltage to the rectifier, or an output voltage from the inverter. The load output to be detected may be the lamp current, a lamp voltage, a lamp power, or a resonant current of said resonant circuit. The detected load output is utilized in a feedback circuit which modulates the control signal based upon the detected load output in consideration of the conditional signal for reducing the ripple and crest factor.

The ripple reducing circuit may comprise an error amplifier which amplifies an error between the lamp current being detected and a reference voltage, and means for varying an amplification factor of the error amplifier in accordance with the conditional signal.

Alternately, the ripple reducing circuit may include in addition to the error amplifier of which reference voltage is varied in accordance with the conditional signal.

These and still other objects and advantageous features will become more apparent from the following description of the drawings when taken in conjunction with the attached drawings.

DETAILED DESCRIPTION OF THE EMBODIMENTS

First Embodiment

Figure 1:
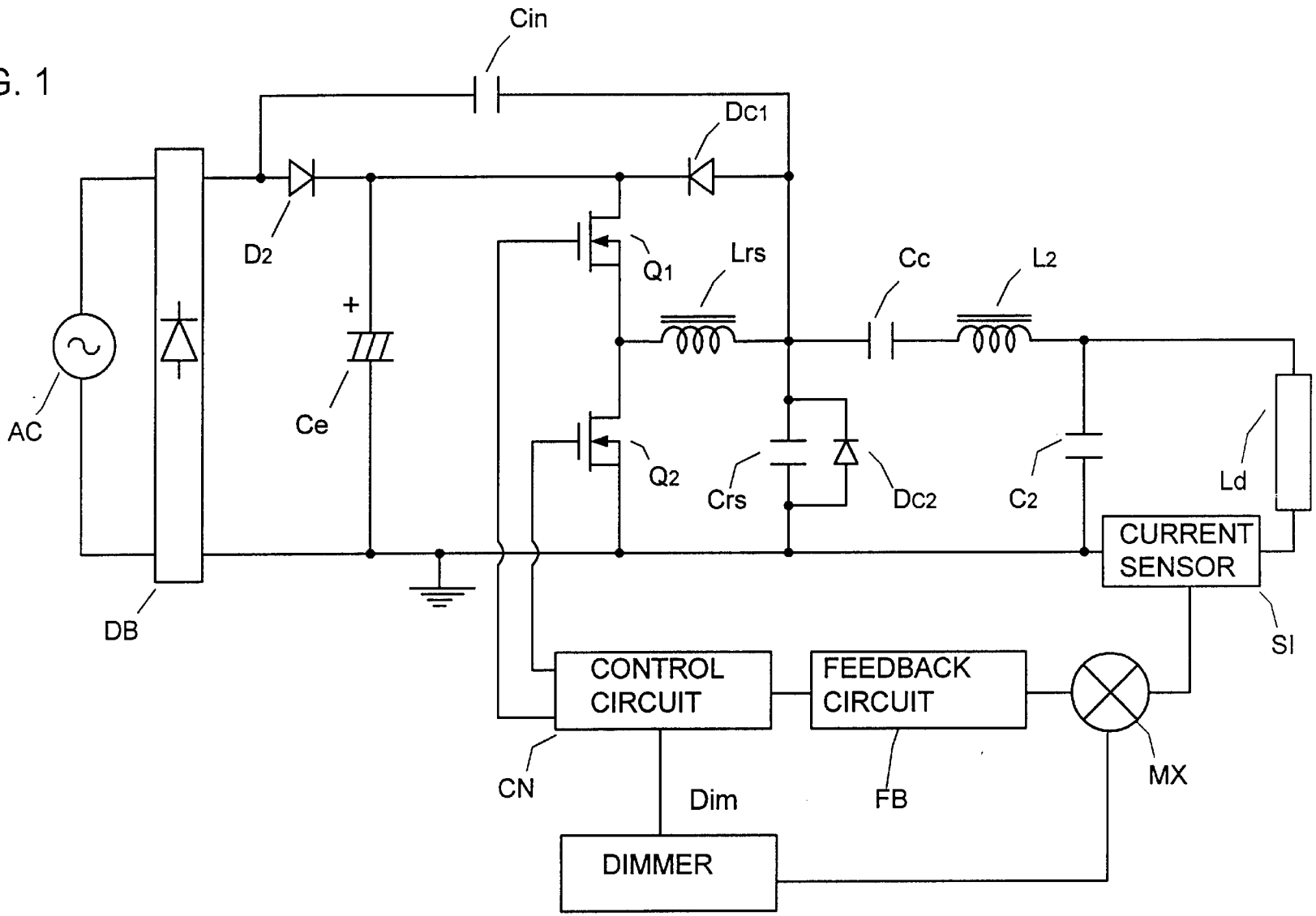
FIG. 1 is a rather schematic circuit diagram of a discharge lamp driving circuit in accordance with a first embodiment.
Figure 29:
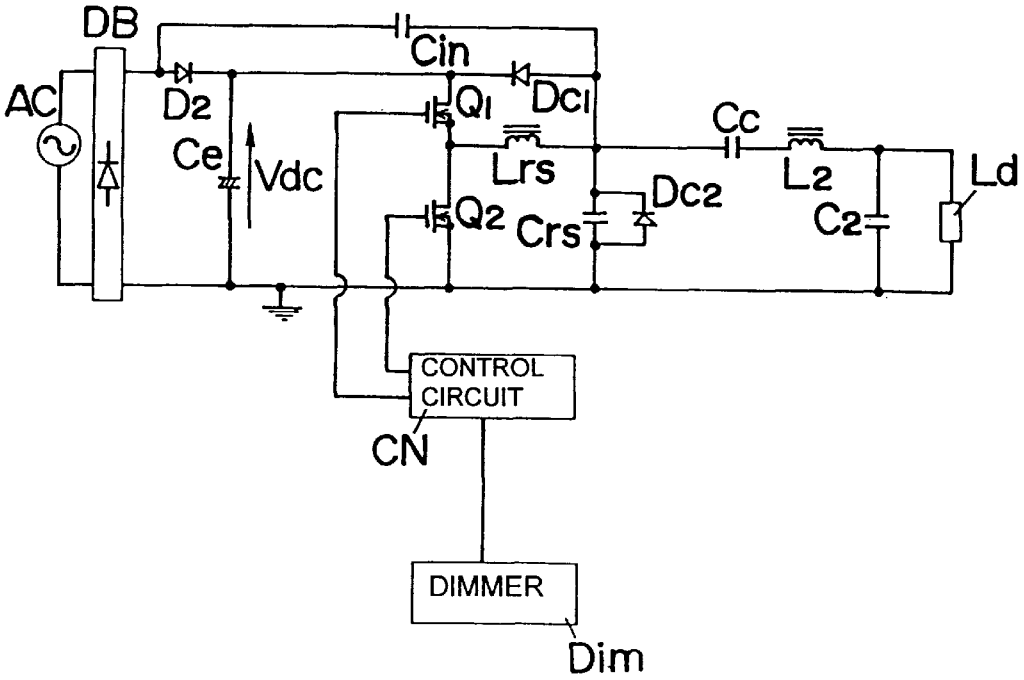
FIG. 29 (PRIOR ART)
FIG. 29 is a circuit diagram of a further prior discharge lamp driving circuit.
Figure 30A:
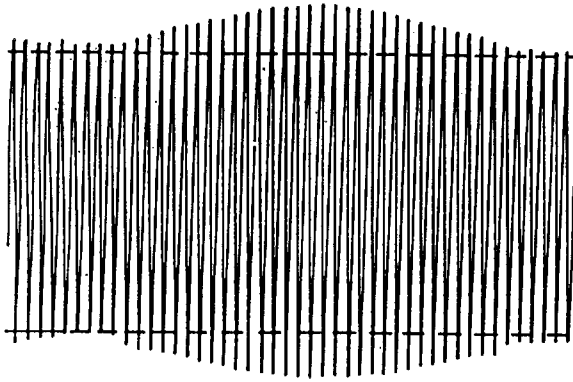
FIG. 30A (PRIOR ART)
FIGS. 30A and 30B are waveform charts illustrating the operation of the above prior circuit.
Figure 30B:
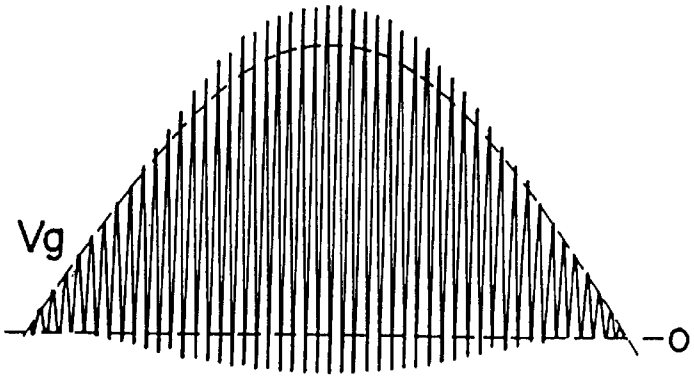
FIG. 30B (PRIOR ART)
Figure 31A:
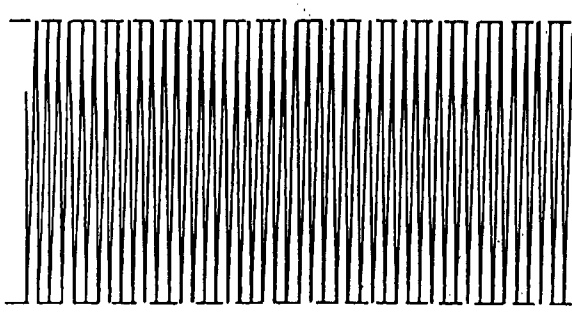
FIG. 31A (PRIOR ART)
FIGS. 31A and 31B are waveform charts illustrating the operation of the above prior circuit.
Figure 31B:
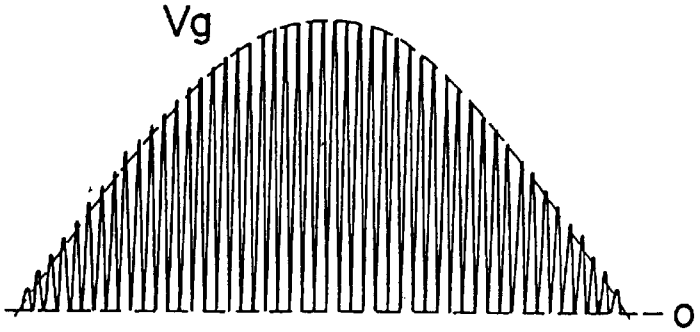
FIG. 31B (PRIOR ART)
Figure 32:
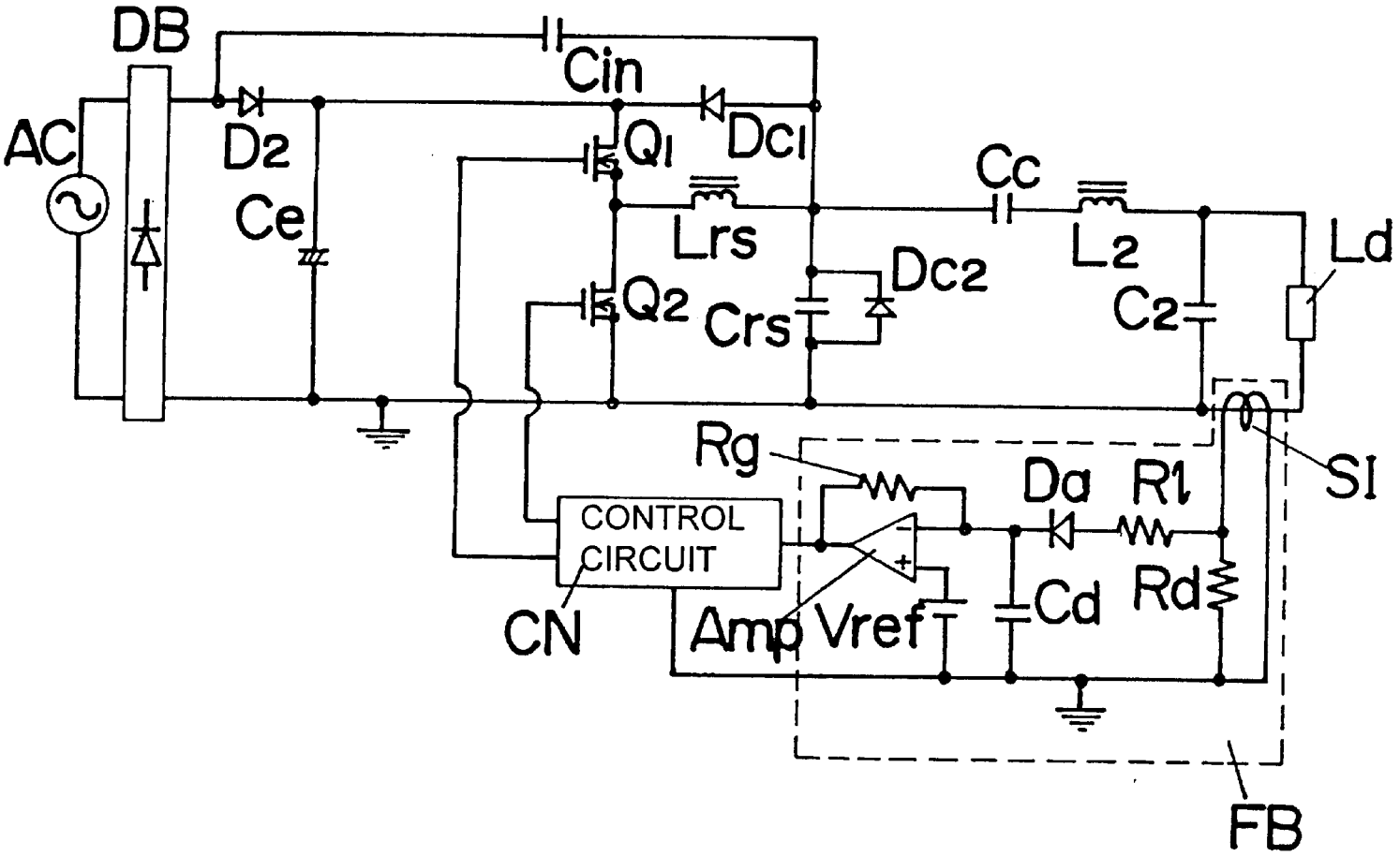
FIGS. 32 and 33 are circuit diagrams, respectively illustrating possible modifications of the above prior circuit.
Figure 33:
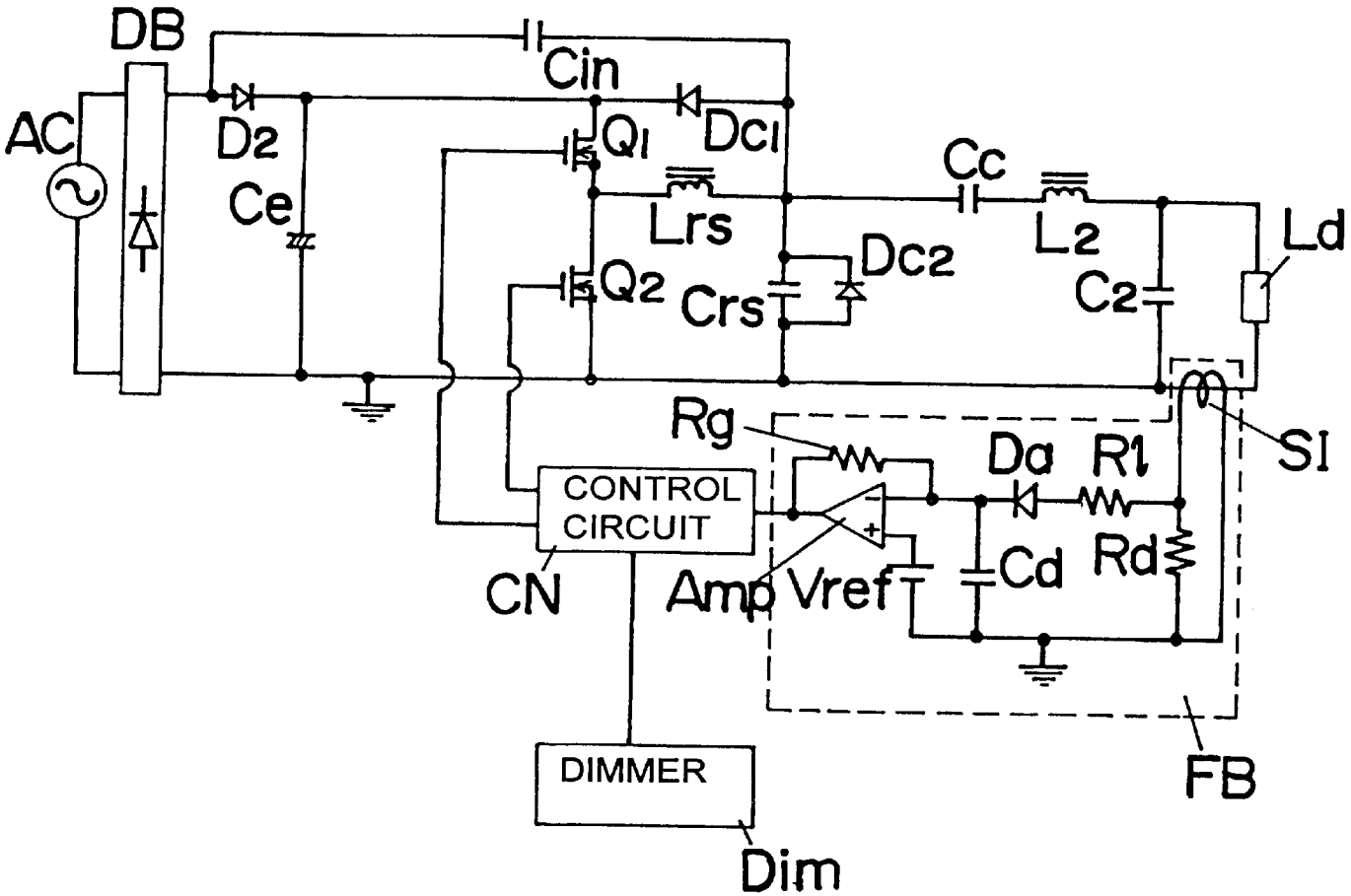

Referring now to FIG. 1, there is shown a discharge lamp driving circuit in accordance with a first embodiment of the present invention which improves the prior circuit of FIG. 29 to enable a consistent dimming control. The circuit comprises a rectifier DB of diode bridge for full-wave rectification of an alternating current power source AC such as AC mains, a smoothing capacitor Ce connected across the output ends of rectifier DB through a diode D2, and a pair of switching elements Q1 and Q2 connected in series across smoothing capacitor Ce. MOSFET is employed as each of the switching elements Q1 and Q2. Connected across switching elements Q2 on the negative terminal side of the smoothing capacitor Ce is a series combination of an inductor Lrs and a capacitor Crs. A series combination of an inductor L2 and capacitor C2 is connected across capacitor Crs through a DC blocking capacitor Cc. A discharge lamp Ld is connected across capacitor C2. A capacitor Cin is interposed between one end of inductor Lrs adjacent capacitor Crs and the anode of diode D2. A diode $D_{C1}$ is interposed between the one end of inductor Lrs adjacent capacitor Crs and the cathode of diode D2 with the cathode of diode $D_{C1}$ connected to cathode of diode D2. A diode $D_{C2}$ is connected across capacitor Crs with the cathode of diode $D_{C2}$ connected to the negative output terminal of rectifier DB. The discharge lamp Ld is a fluorescent lamp. However, the present invention is not limited to the use of the fluorescent lamp and may use other types of discharge lamps such as metal halide lamp and high density sodium-vapor lamp.

A current sensor SI is provided to detect a lamp current being fed to discharge lamp Ld and gives a current output which is fed back through a feedback circuit FB to a control circuit CN. Control circuit CN is included to generate a control signal for alternately turning on and off the switching elements Q1 and Q2, and comprises an oscillator, a signal generator, and a driver. The oscillator gives off a square-wave reference signal determining a switching frequency of elements Q1 and Q2. The signal generator produces a duty signal having a desired duty from the reference signal. Based upon the duty signal, the driver makes the control signal which turns on and off the switching elements Q1 and Q2 alternately in such a manner as to turn on one of the switching elements Q1 and Q2 for the ON-period of the duty signal and turn on the other switching element for the OFF-period of the duty signal. The output frequency of the oscillator is allowed to vary for adjusting the switching frequency of Q1 and Q2, while the signal generator is allowed to vary an a duty of the duty signal for adjusting a on-duty ratio of the ON-period of switching element Q1 to that of switching element Q2. The control circuit may configured to have an additional function of adjusting a dead-off time in which both of switching elements Q1 and Q2 are kept turned off at switchover from Q1 to Q2 or vice versa. When adjusting the dead-off time, the duty ratio is determined as a ratio of the sum of the on-period of the one switching element plus the dead-off time to the sum of the on-period of the other switching element plus the dead-off time. Therefore, it is made possible to adjust the switching frequency, on-duty ratio, and the dead-off time independently from each other.

Feedback circuit FB is designed to extract the ripple included in the envelop of the lamp current being fed to discharge lamp Ld and determine an error between thus extracted ripple and a predetermined reference voltage. Feedback circuit FB is cooperative with control circuit CN to form a ripple reducing circuit which effects a feedback control of suppressing the variation in the lamp current.

Connected to the control circuit CN is a dimmer which constitutes a conditional signal generating circuit which provides a dimmer signal Dim in the form of a DC voltage signal for dimming the lamp. In response to the dimmer signal Dim, control circuit CN operates to vary at least one of switching frequency, duty ratio, and the dead-off time of the control signal. Dimmer signal Dim is also fed to a mixer MX which adjusts a variation extent of the lamp current detected at current sensor SI in accordance with a dim level intended by dimmer signal Dim. Mixer MX is configured to output a signal of increasing amplitude as the dim level gets higher to reduce the lamp current. That is, the dim level is associated with a modulation range in which the control signal is allowed to vary such that the control signal is made to have a greater modulation range as the dim level is higher. Thus, the crest factor of the lamp current can be greatly reduced.

Figure 2:
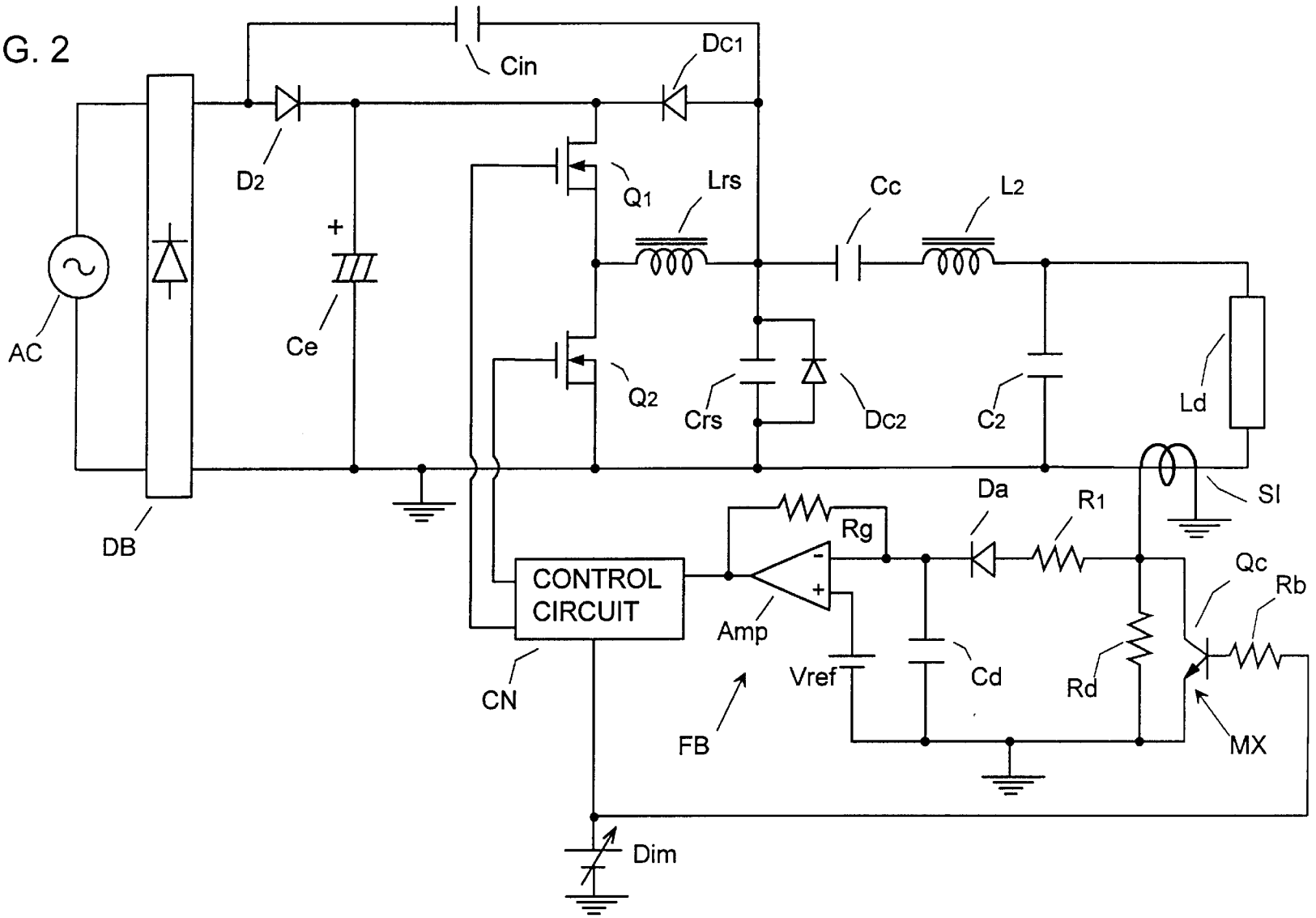
FIG. 2 is a detailed circuit diagram of the above circuit.

FIG. 2 illustrates concrete configurations of current sensor SI, feedback circuit FB, and mixer MS. Current sensor SI is made of a current transformer. Mixer MX comprises a resistor Rd developing a voltage corresponding to an output current of current sensor SI, and a transistor Qc having a collector-emitter path connected across resistor Rd. Transistor Qc receives dimmer signal Dim in the form of the voltage signal at its base through a resistor Rb to vary degree of conduction (i.e., equivalent resistance in collector-emitter path) in accordance with the dimmer signal Dim, thus varying a voltage across resistor Rd. That is, as the voltage level of dimmer signal Dim increases, transistor Qc decrease its equivalent resistance to correspondingly lower the voltage across resistor Rd. Dimmer signal Dim is set to have a lower voltage as the dim level is higher so that equivalent resistance of transistor Qc increases to give a large amplitude of voltage across resistor Rd as the dim level is higher. In this manner, it is possible to vary conversion factor (input/output factor) by which the lamp current detected at current sensor SI is converted to the resulting voltage, in accordance with the dimmer signal Dim.

Feedback circuit FB comprises a delay circuit of resistor Rd, resistor R1, diode Da, and capacitor Cd, and an error amplifier Amp which gives the error between the output of the delay circuit and the reference voltage Vref. Resistor R1 and capacitor Cd are made to block the high frequency component as high as the switching frequency while allowing the low frequency component as low as that of the power source AC so that a DC voltage signal including low frequency ripple seen in the lamp current is fed to error amplifier Amp.

In accordance with dimmer signal Dim, control circuit CN determines the on-duty ratio of the control signal as well as determines the switching frequency of the control signal for controlling the switching elements Q1 and Q2 in such a manner as to decrease the lamp current as the input voltage to error amplifier Amp increases and to increase the lamp current as the input voltage to error amplifier decreases. That is, a control is made based upon the output of error amplifier, i.e., the output of feedback circuit FB to adjust the switching frequency of Q1 and Q2. With this control, it is made to feed the lamp current of substantially constant level to discharge lamp Ld with reduced crest factor at the normal or rated lighting operation. It is noted in this connection that the control signal can be modulated for at least one of the switching frequency, duty ratio, and dead-off time in accordance with the output from feedback circuit FB and the dimmer signal Dim.

The crest factor of the lamp current at the dimmer operation can be reduced by the provision of mixer MX in which transistor Qc has its collector-emitter path connected across resistor Rd. As described hereinbefore, dimmer signal Dim is made to have decreasing voltage as the intended dim level is higher, which reduces base current of transistor Qc with correspondingly increasing equivalent resistance of transistor Qc over the collector-emitter path, thereby increasing the amplitude of voltage input to error amplifier Amp and therefore increasing the amplitude of the output voltage from the error amplifier. Consequently, the control signal for Q1 and Q2 can be modulated within a predetermined range so as to sufficiently reduce the crest factor at the time of dimming the lamp.

Although transistor Qc is utilized in mixer MX to vary the lamp current, the present invention is not limited to the use of transistor and may instead include alternate element or circuit that can vary the amplitude of the detected lamp current in accordance with the varying dim level. In order to reduce high frequency ripple in the voltage across capacitor Cd, feedback circuit FB may be modified to include a full-wave rectifier instead of diode Da responsible for half-rectification of the detected lamp current. The oscillator of control circuit CN may be a voltage controlled oscillator (VCO) which is connected to vary its output frequency in response to the output from error amplifier Amp.

Figure 3A:
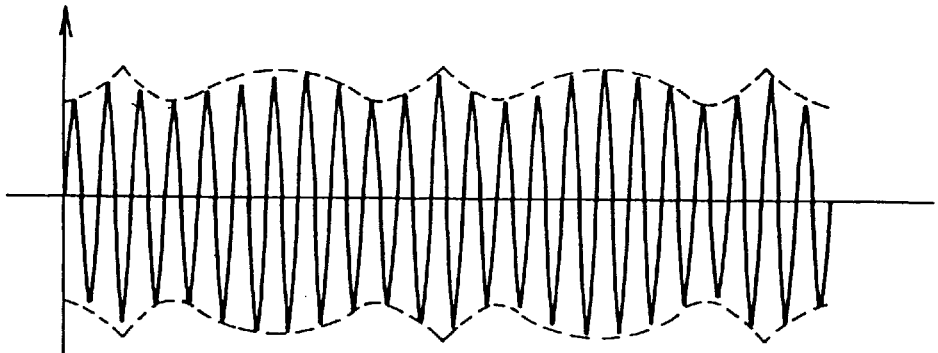
FIGS. 3A to 3D are waveform charts explaining the operation of the above circuit.
Figure 3B:
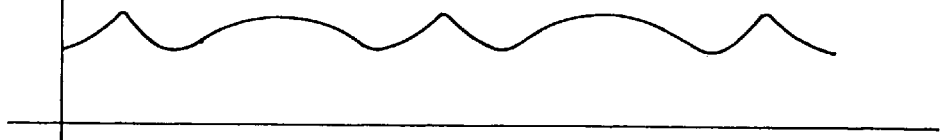
Figure 3C:
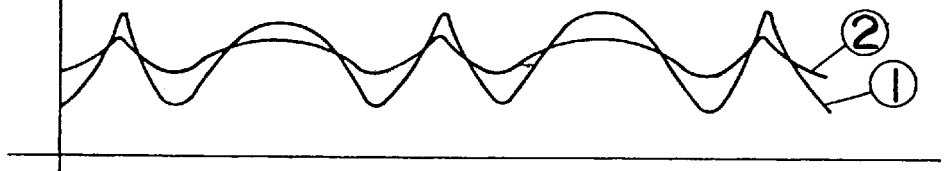
Figure 3D:
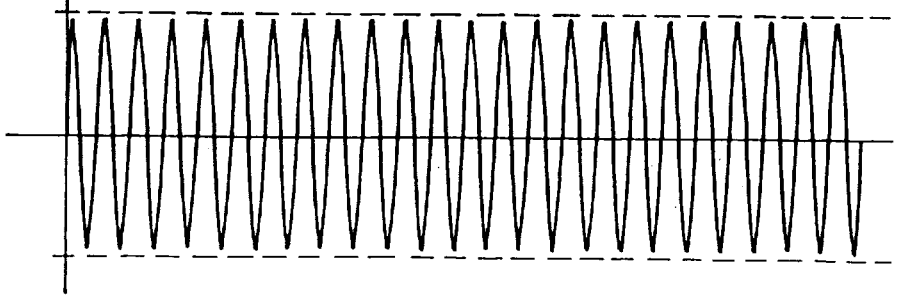

When dimming the lamp without the use of mixer MX, the envelop of the lamp current includes low frequency ripple, as shown in FIG. 3A so that output from current sensor SI has a waveform as shown in FIG. 3B. In contrast, mixer MX provides the output of waveform as indicated by ① in FIG. 3C (in which waveform of FIG. 3B is indicated by ② for easy comparison). As is seen from FIG. 3C, the output ① from mixer MX has an increased amplitude in such a manner as to emphasize the low frequency ripple, which enables to maintain the envelop of lamp current substantially at a constant level. Thus, it is made to greatly reduce the ripples from the lamp current and therefore reduce the crest factor to a largest extent.

Second Embodiment

Figure 4:
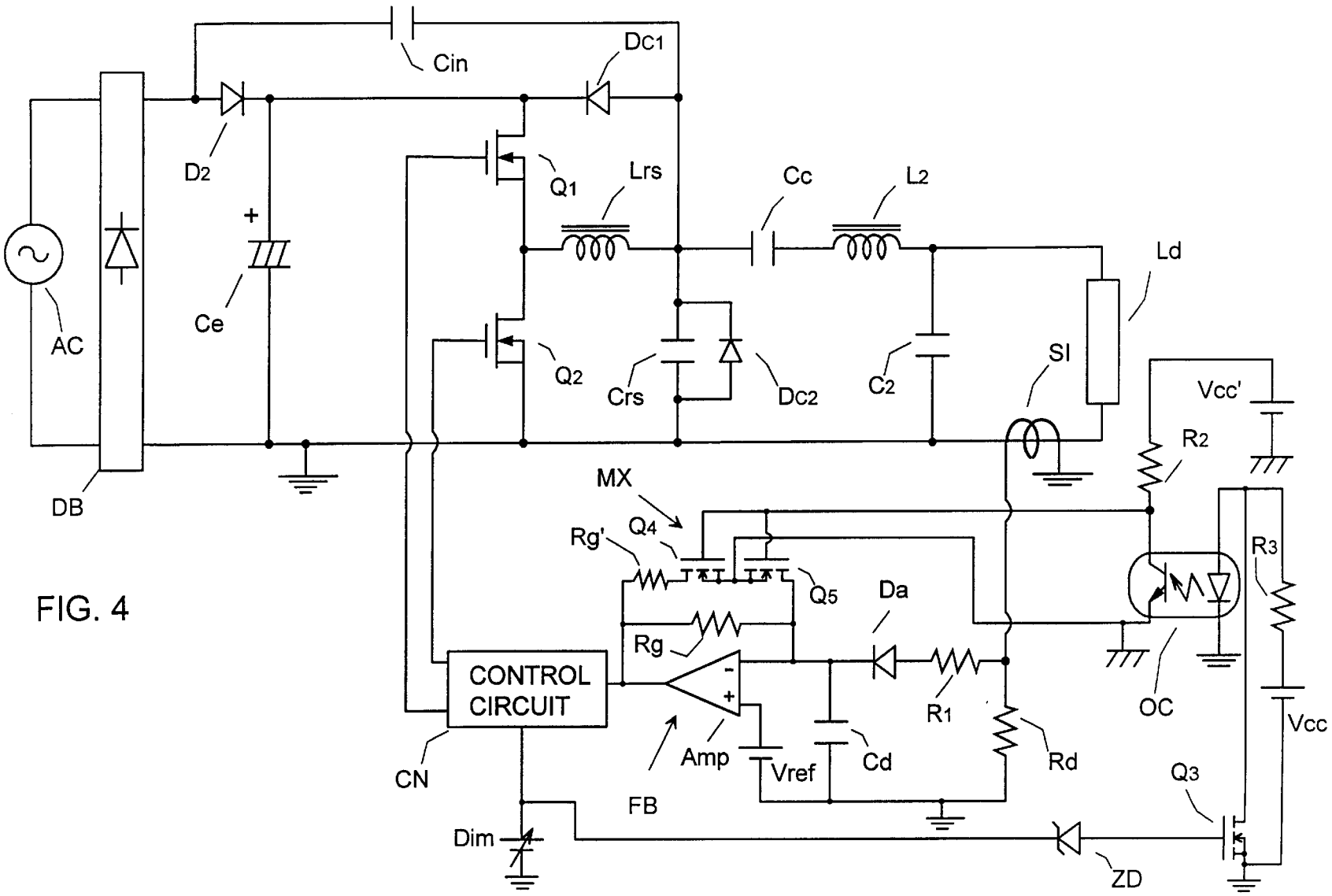
FIG. 4 is a circuit diagram of a discharge lamp driving circuit in accordance with a second embodiment of the present invention.

FIG. 4 illustrates a discharge lamp driving circuit in accordance with a second embodiment of the present invention. Dimmer is connected to apply the dimmer signal Dim to the gate of a MOSFET switching element Q3 through a zener diode ZD. Connected across switching element Q3 is a series combination of a resistor R3 and a DC voltage source Vcc. Also a light emitting diode of an optocoupler OC is connected across switching element Q3 so that light emitting diode turns on and off in response to switching element Q3 being turned off and on, respectively. When dimmer signal Dim indicative of predetermined dim level is applied, zener diode ZD is caused to be turned off, thereby turning off switching element Q3 and therefore turning on the light emitting diode of optocoupler OC.

Optocoupler OC has a photodetector connected in series with a resistor R2 and a DC voltage source Vcc'. The photodetector is also connected to control a pair of switching elements Q4 and Q5 which are connected in series with a resistor Rg' across a resistor Rg determining amplification factor of error amplifier Amp. When switching elements Q4 and Q5 are turned on, resistor Rg' becomes connected in parallel with resistor Rg to give a low combined resistance for lowering the amplification factor at the error amplifier. Switching elements Q4 and Q5 are connected to be turned on when the photodetector of optocoupler is turned off as a result of switching element Q3 being turned on. That is, when the dim level represented by dimmer signal Dim is low to keep switching element Q3 turned on, error amplifier Amp is given a low amplification factor determined by combined resistance of Rg and Rg', and when the dim level exceeds the predetermined level, error amplifier operates at the higher amplification factor determined by resistor Rg.

Consequently, when the high dim level is selected to increase the low frequency ripples in the envelop of the lamp current, error amplifier Amp is given an increased amplification factor so as to widen the modulation width of the control signal, which enables to reduce the ripples in the envelop of the lamp current at the time of dimming the lamp, as effected in the previous embodiment. Although the illustrated embodiment utilizes a single zener diode ZD for providing two dim level and therefore two high and low amplification factors, it may be equally possible to give a multi-level dimming control with corresponding multi-stage amplification factors for the error amplifier. The other configurations and operations are identical to those of the first embodiment.

Third Embodiment

Figure 5:
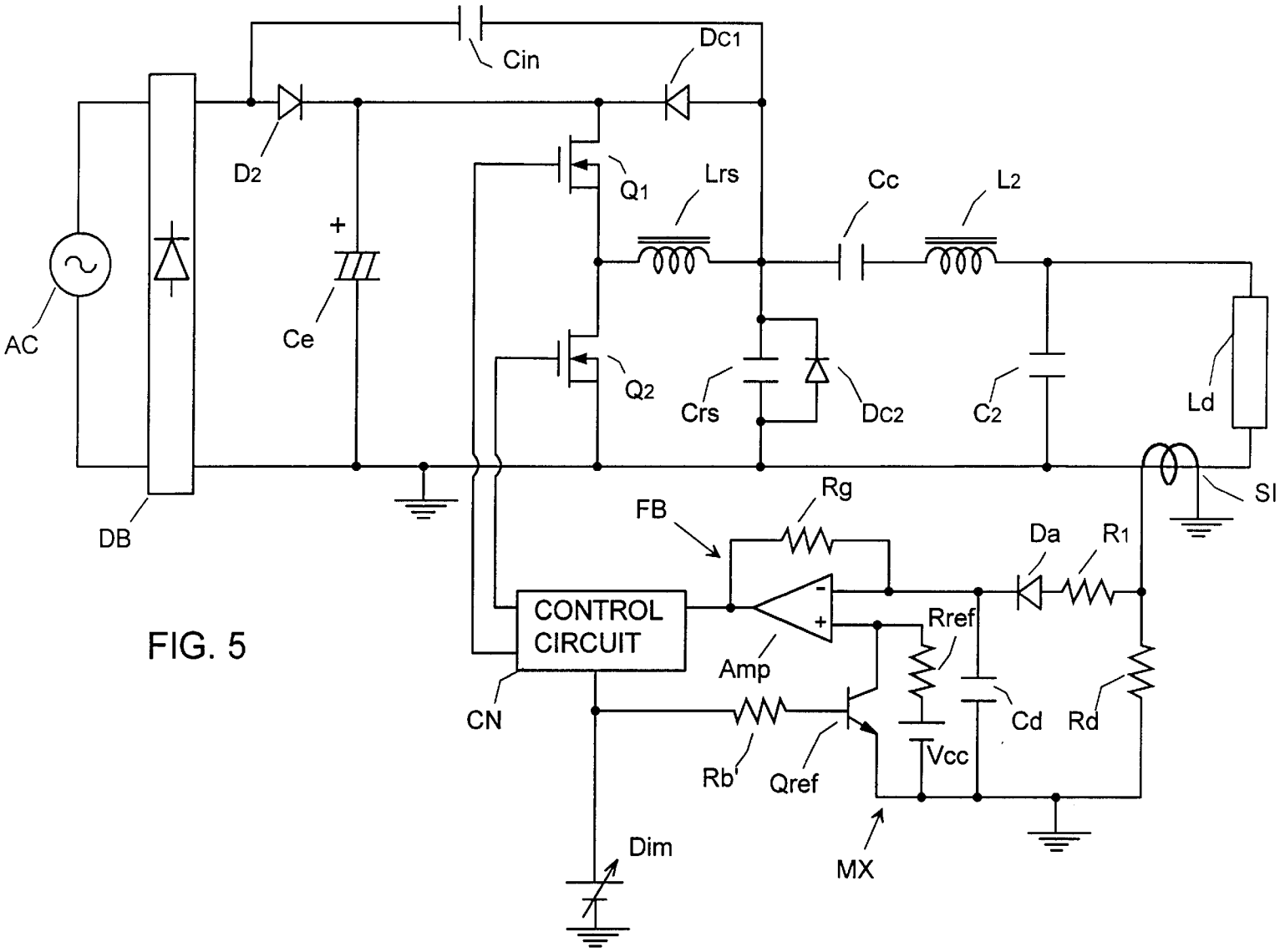
FIG. 5 is a circuit diagram of a discharge lamp driving circuit in accordance with a third embodiment of the present invention.

FIG. 5 illustrates a discharge lamp driving circuit in accordance with a third embodiment of the present invention in which a reference voltage Vref for the error amplifier Amp is controlled to vary for realizing the same function as in the first embodiment. To this end, a reference resistor Rref is connected in series with a reference voltage source Vcc across the collector-emitter path of transistor Qref. The dimmer signal Dim is fed through resistor Rb' to the base of transistor Qref so that transistor Qref varies its conductivity in accordance with varying voltage level of dimmer signal Dim. Conductivity variation of transistor Qref results in corresponding variation in equivalent resistance of collector-emitter path of transistor Qref. Thus, it is made to adjust the variation width, i.e., modulation width of the output from error amplifier Amp, i.e., the modulation range of the control signal in accordance with the required dim level. That is, as the dim level is higher, transistor Qref receives increasing base current to lower the voltage across collector-emitter path and therefore decrease the reference voltage Vref input to error amplifier Amp.

Figure 6A:
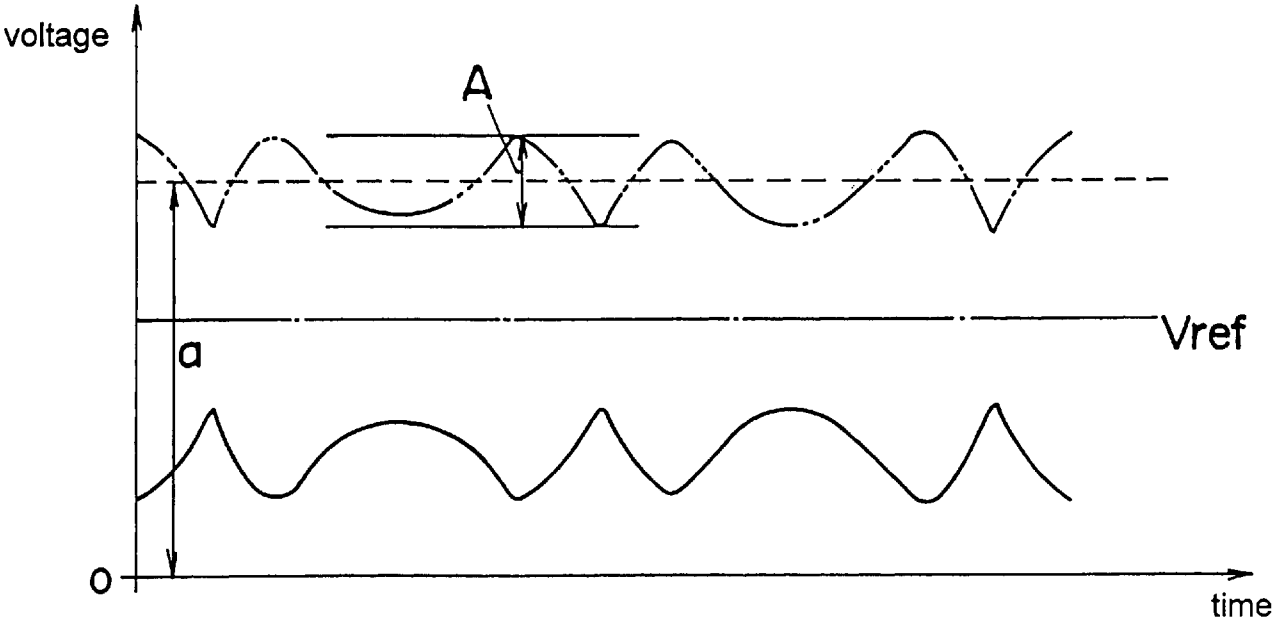
FIGS. 6A and 6B are waveform charts illustrating the operation of the above embodiment.
Figure 6B:
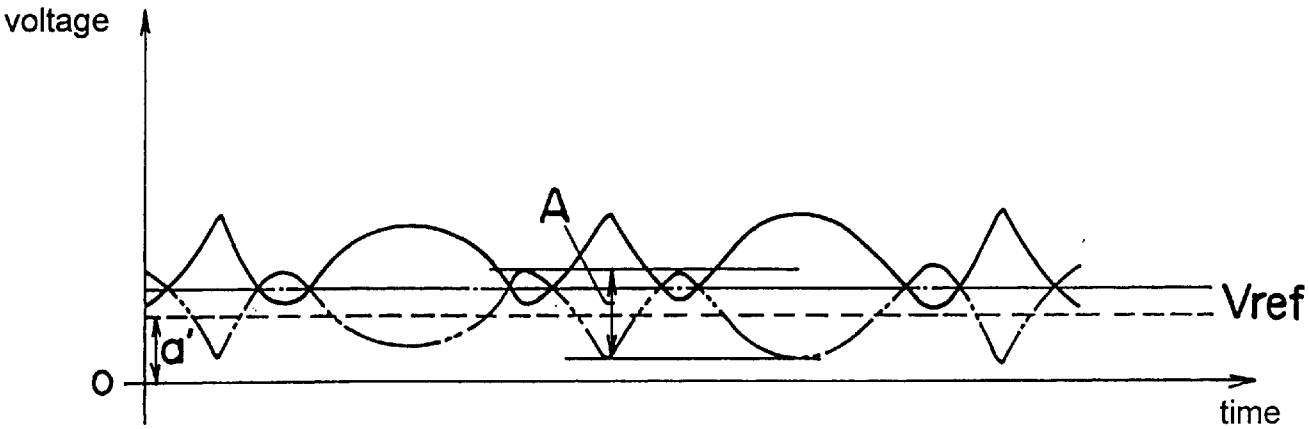

Considering a case when reference voltage Vref is relatively high to have a relation, as shown in FIG. 6A, with voltage (indicated by solid line in the figure) developed across capacitor Cd and fed to the input of error amplifier Amp, in the absence of transistor Qref, the output voltage of error amplifier Amp would take a waveform, as indicated by dotted line, in which reference voltage Vref is added to the reversed voltage of capacitor Cd. In contrast when reducing reference voltage Vref in response to the increased dim level in the presence of transistor Qref, output of error amplifier Amp will decreases as shown in FIG. 6B. This is expressed by A/a<A/a' in which "a" indicates a DC component of the voltage shown in FIG. 6A, "a'" indicates a DC component of the voltage shown in FIG. 6B, and "A" indicates a variation width of the ripple (which corresponds to the modulation width of the control signal). Thus, adjustment of reference voltage Vref in association with the dimmer signal Dim can enhance the ratio of the rippled contained in the output from the error amplifier Amp and therefore enhance the ripple, thereby suppressing the low frequency ripple and crest factor in the envelop of the lamp current. The other configurations and functions are identical to those of the first embodiment.

Fourth Embodiment

Figure 7:
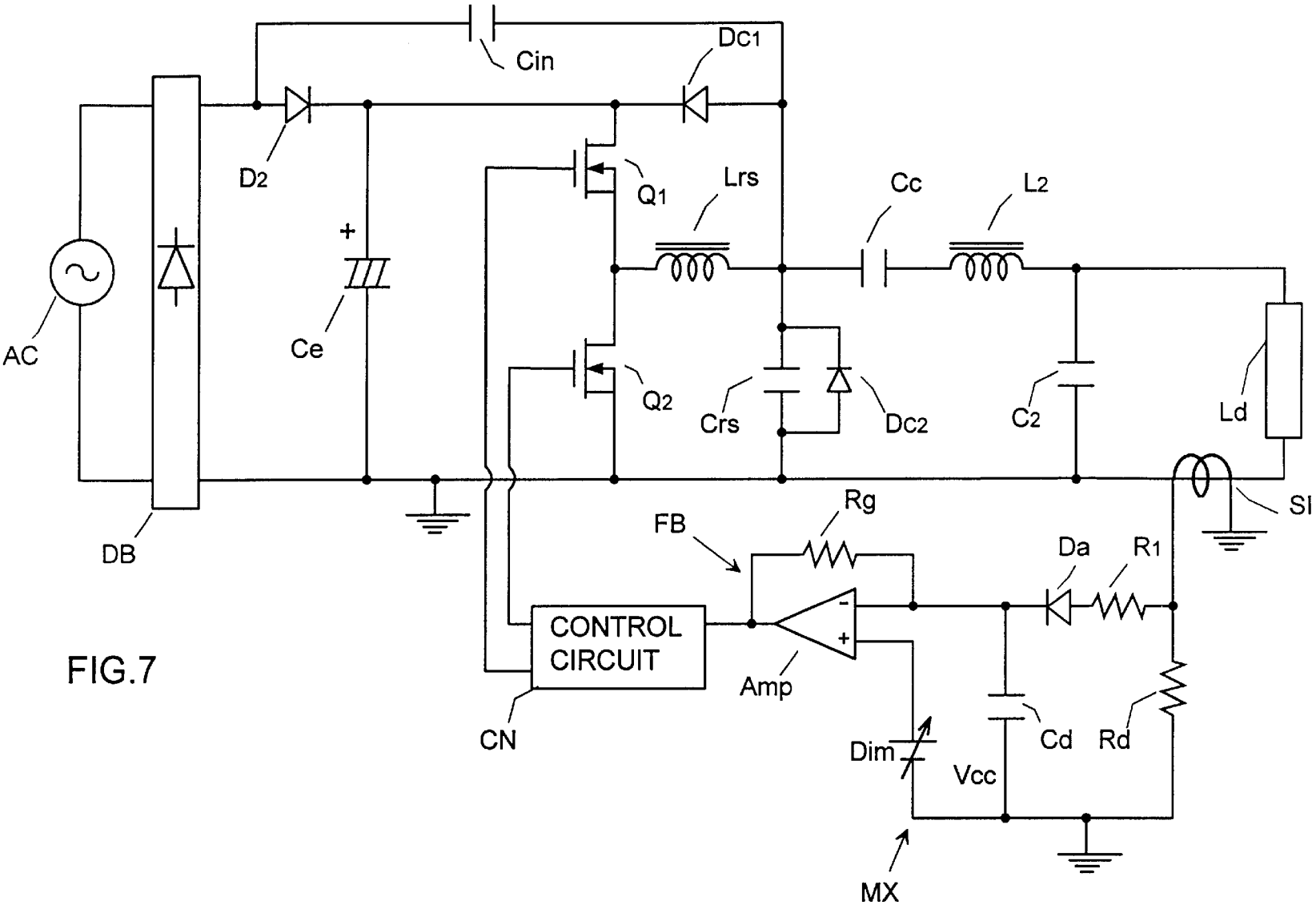
FIG. 7 is a circuit diagram of a discharge lamp driving circuit in accordance with a fourth embodiment of the present invention.

FIG. 7 illustrates a discharge lamp driving circuit in accordance with a fourth embodiment of the present invention in which the dimmer signal Dim determines the reference voltage of error amplifier Amp so as to minimize the lamp current when the dim level is maximum and maximize the lamp current when the dim level is minimum. As the dim level is higher to decrease the voltage dim signal Dim, error amplifier Amp operates in the same manner as in the third embodiment to widen the modulation range of the control signal for reducing the crest factor in the lamp current. This embodiment eliminates the necessity of giving the dimmer signal to control circuit CN, and therefore enables to effect the dimmer control as well as suppression of crest factor in accordance with the intended dim level in a simple circuit configuration.

In order to detect the low frequency ripples in the output of the inverter, the first and second embodiments utilize the current transformer for detection of the lamp current having the low frequency ripple, however, an alternate scheme may be also available to detect a resonant current flowing through inductor L2 of the resonant circuit connected to lamp Ld, or a current flowing through switching elements Q1 and Q2.

Fifth Embodiment

Figure 8:
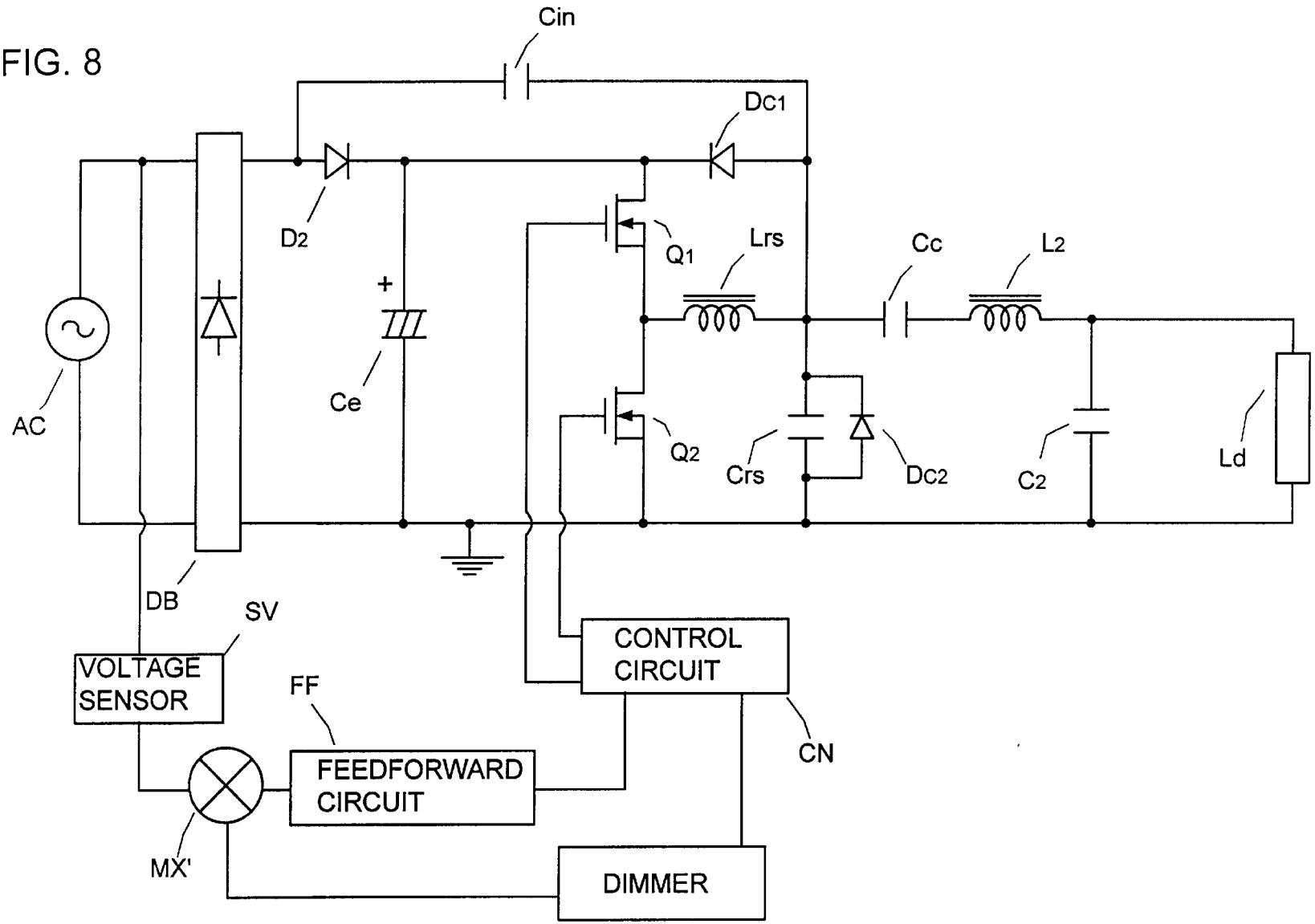
FIG. 8 is a circuit diagram of a discharge lamp driving circuit in accordance with a fifth embodiment of the present invention.

FIG. 8 illustrates a discharge lamp driving circuit in accordance with a fifth embodiment of the present invention in which switching elements Q1 and Q2 are controlled in a feed-forward manner based upon the input voltage or current to rectifier DB.

Figure 9A:
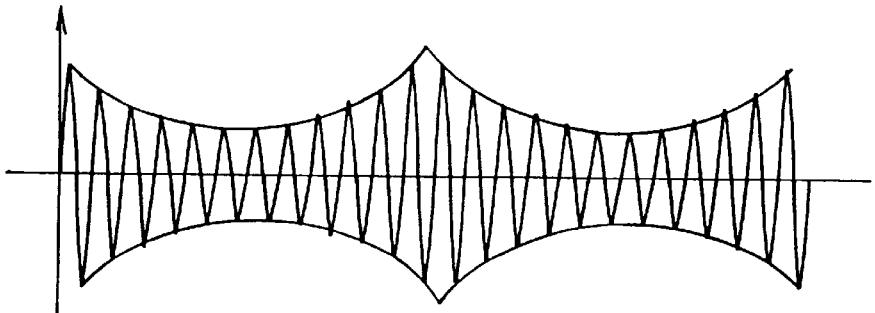
FIGS. 9A to 9E are waveform charts explaining the operation of the above circuit.
Figure 9B:
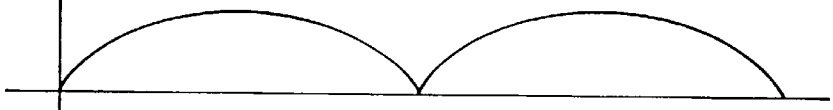
Figures 10A, 10B, 10C, 10D, 10E:
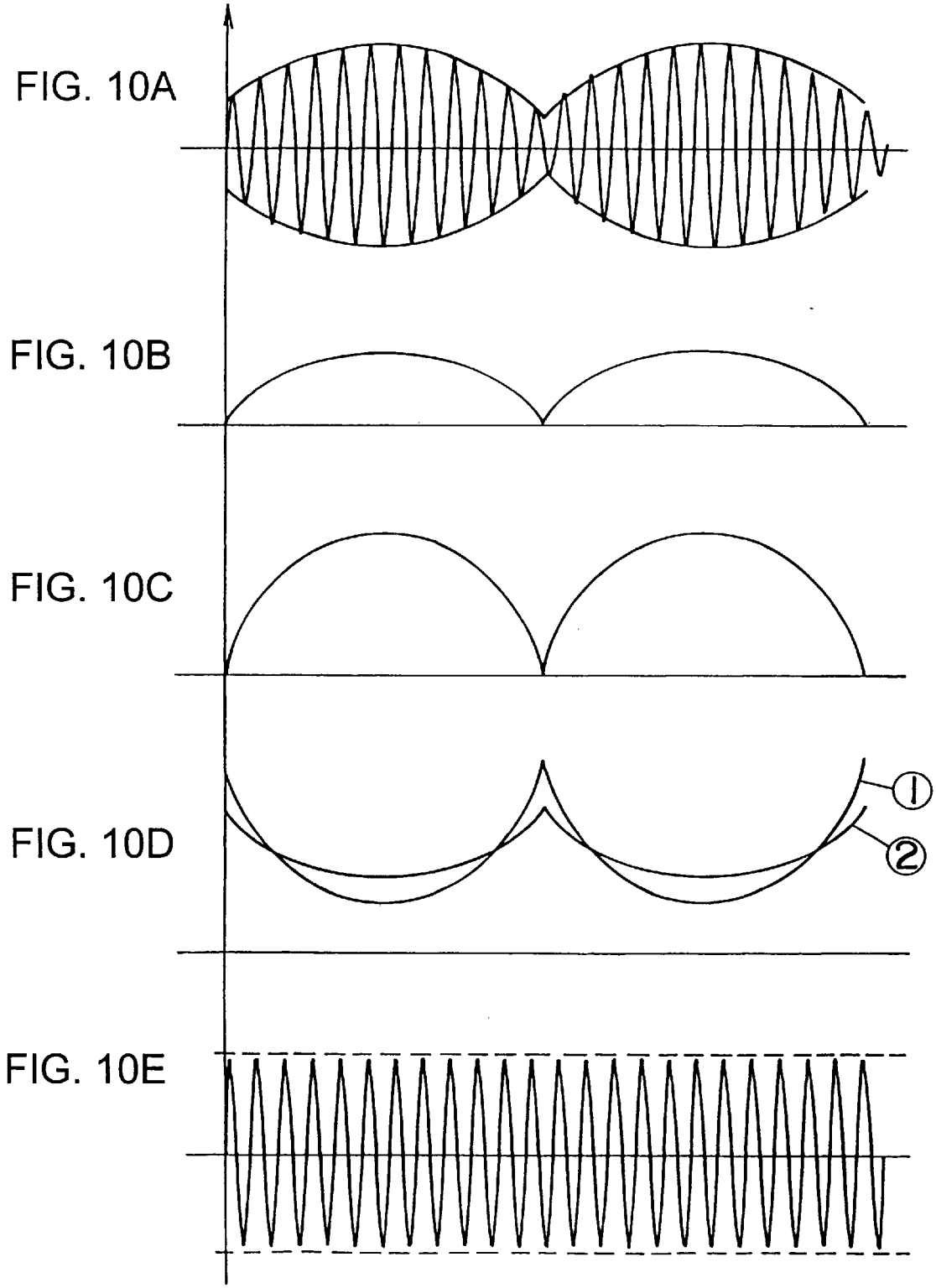
FIGS. 10A to 10E are waveform charts explaining the operation of the above circuit.

Generally, the discharge lamp drive circuit has a tendency of varying the lamp current (FIG. 9A) in the opposite direction from the varying direction of the input voltage to the inverter, i.e., the output voltage of rectifier DB (FIG. 9B), or varying the lamp current (FIG. 10A) in the same direction from the varying direction of the input voltage to the inverter (FIG. 10B). When such tendency becomes significant, the envelop of the lamp current would suffer from increased low frequency ripples and crest factor, which gives rise to flickering of the lamp as well as reduced lamp life. The present embodiment is contemplated to reduce the crest factor of the lamp current by the use of a feed-forward circuit FF.

As shown in FIG. 8, the circuit of the present embodiment includes a voltage sensor SV for detection of the input voltage applied to rectifier DB, a mixer MX' for mixing the detected voltage at voltage sensor SV with the dimmer signal Dim, and feed-forward circuit FF interposed between mixer MX' and control circuit CN. Control circuit CN generates the control signal to turn on and off switching elements Q1 and Q2 at varying duty ratio which varies up to a maximum of 50% in accordance with the output from feed-forward circuit FF. Thus, the feed-forward control is responsible for reducing the variation in the lamp current caused by the varying input voltage to the inverter. In this sense, feed-forward circuit FF is cooperative with control circuit CN to define the ripple suppressing circuit. Mixer MX' is configured to combine the output voltage from voltage detector SV with dimmer voltage signal Dim in such a manner as to give an increasing combined voltage as the dimmer signal gives the high dim level. Thus, even when the lamp current varies to an increased extent when dimming the lamp, the control signal is given a wider modulation width to greatly reduce the crest factor of the lamp current. Mixer MX' may be configured to have a like circuit arrangement as disclosed in the first or fourth embodiment.

Figure 9C:
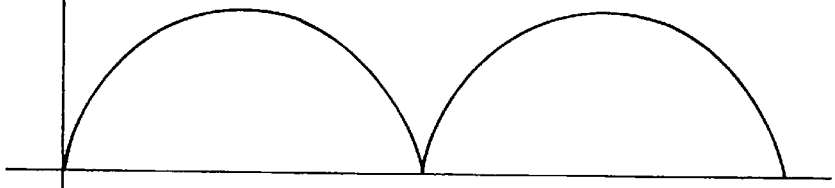
Figure 9D:
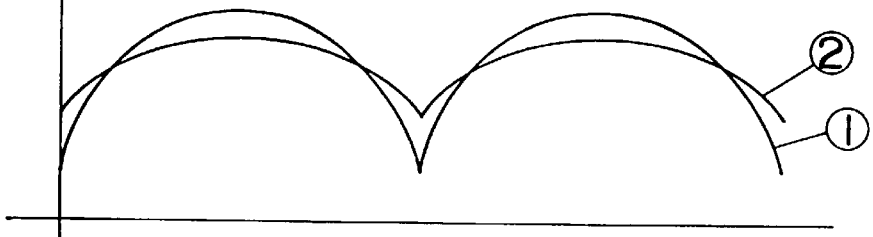
Figure 9E:
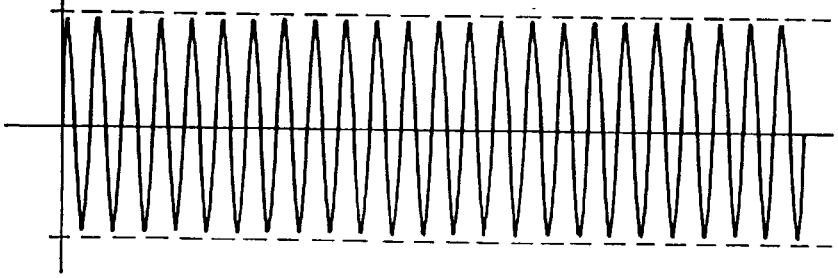

When the dim level becomes high while the lamp current of FIG. 9A and 10A is being fed to the lamp Ld, mixer MX' provides output of the waveforms, respectively as shown in FIGS. 9C and 10C, to feed-forward circuit FF which in turn provides to control circuit CN output voltage of relatively large modulation width, as indicated by ① in FIGS. 9D and 10D, in very contrast to the output voltage (indicated by ② in FIGS. 9D and 10D) obtained in the absence of mixer MX'. Whereby the lamp current is kept substantially at a constant level to suppress the crest factor, as shown in FIG. 9E and 10E. The other configurations and functions are identical to those of first embodiment.

Sixth Embodiment

Figure 11:
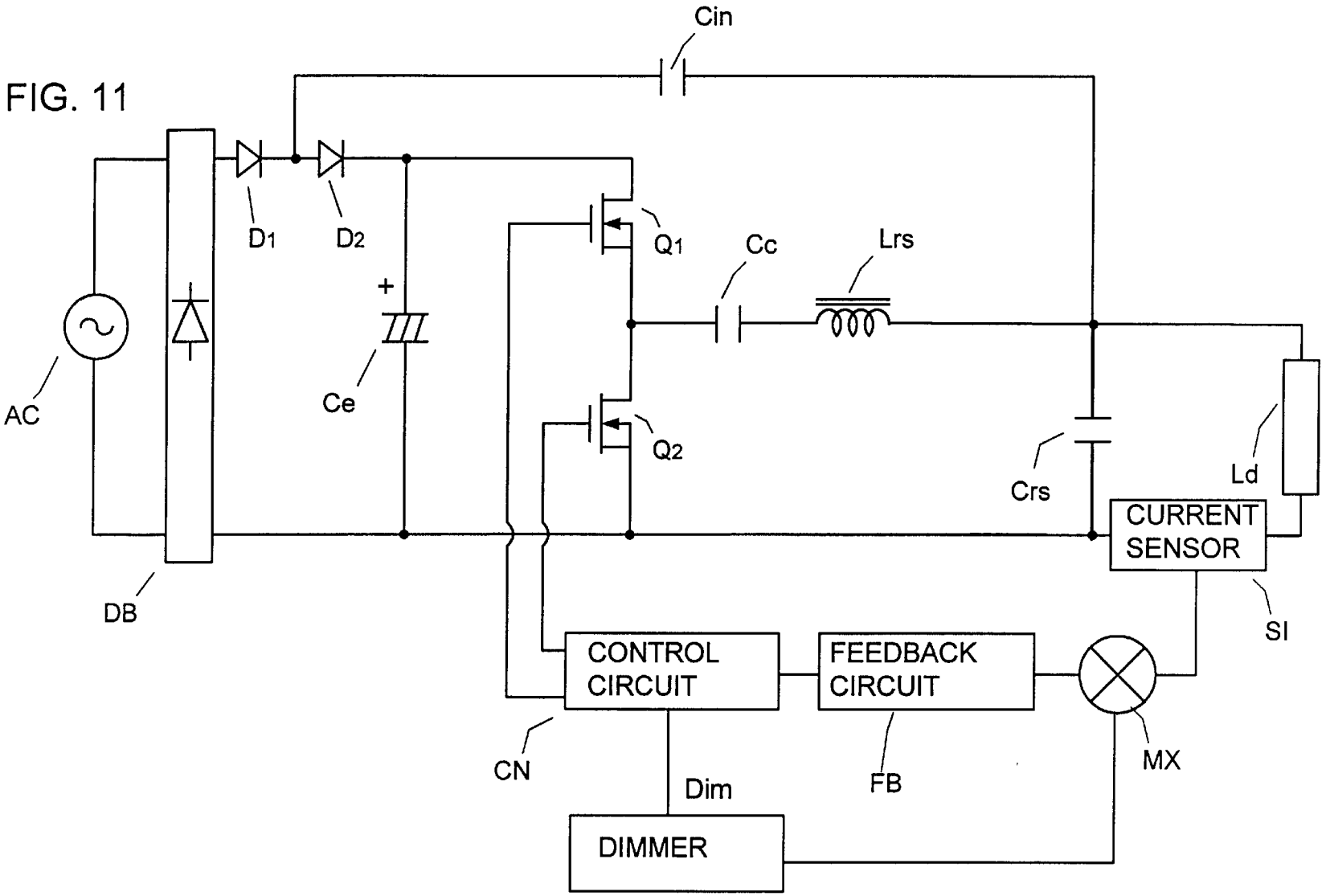
FIG. 11 is a circuit diagram of a discharge lamp driving circuit in accordance with a sixth embodiment of the present invention.
Figure 21:
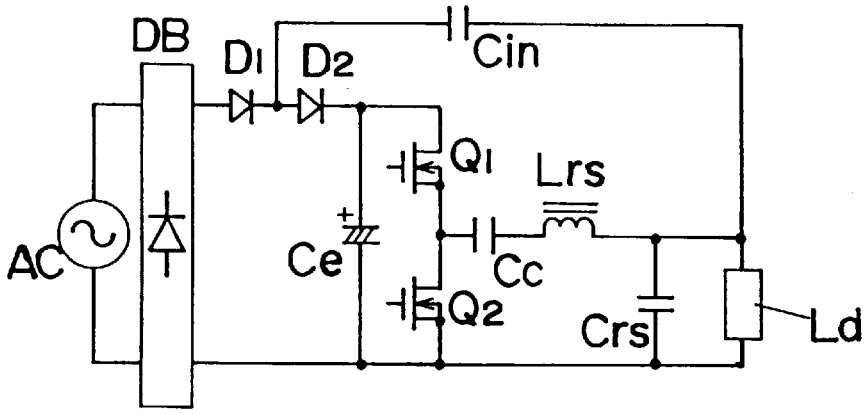
FIG. 21 (PRIOR ART)
FIG. 21 is a circuit diagram of a prior discharge lamp driving circuit.
Figure 22:
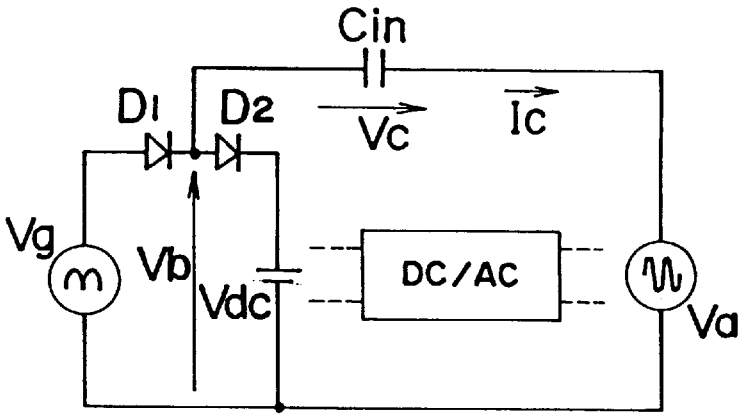
FIG. 22 (PRIOR ART)
FIG. 22 is a circuit diagram of an equivalent circuit of the above prior circuit.
Figure 23A:
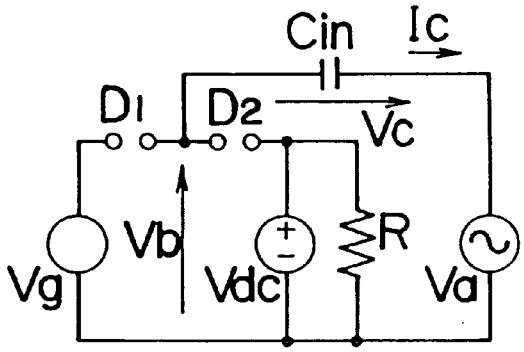
FIG. 23A (PRIOR ART)
FIGS. 23A to 23D illustrate the operation of the above prior circuit.
Figure 23B:
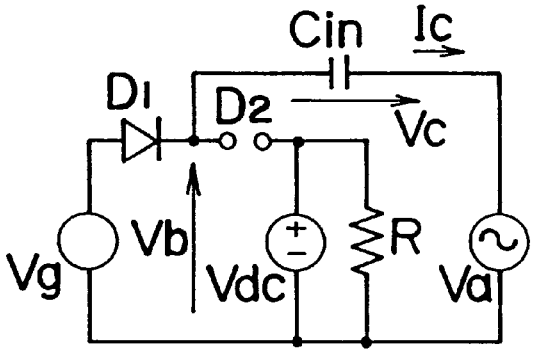
FIG. 23B (PRIOR ART)
Figure 23C:
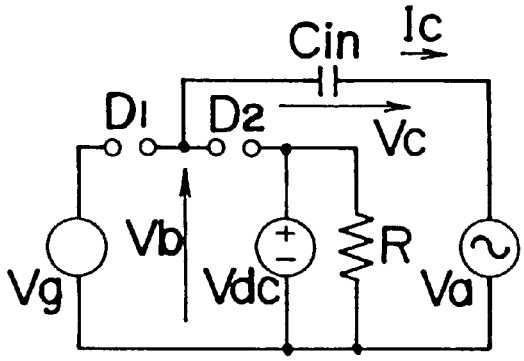
FIG. 23C (PRIOR ART)
Figure 23D:
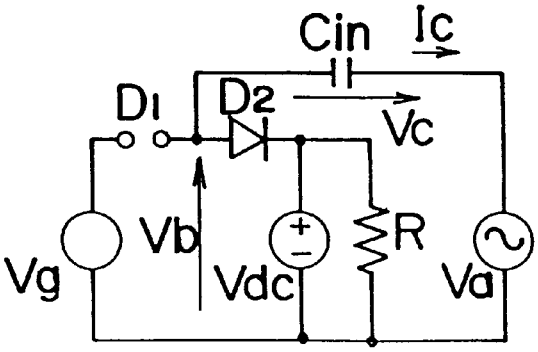
FIG. 23D (PRIOR ART)
Figure 24:
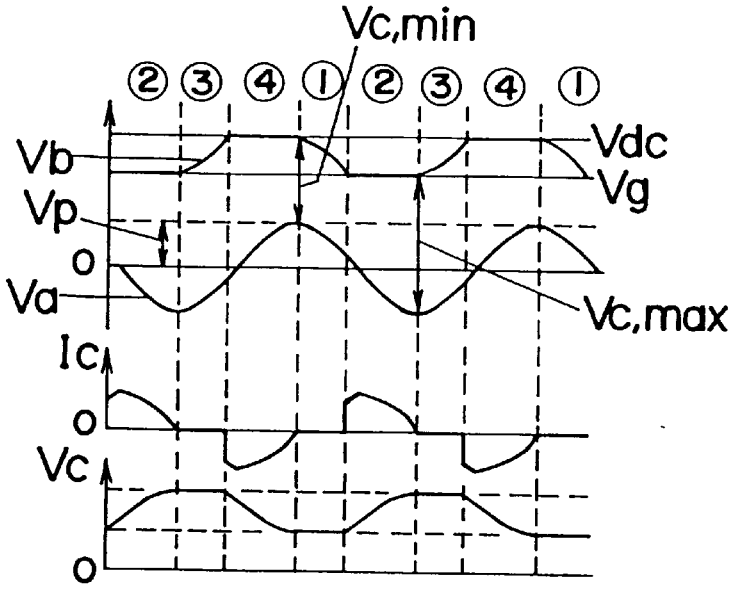
FIG. 24 (PRIOR ART)
FIG. 24 is waveform chart illustrating the operation of the above prior circuit.
Figure 25A:
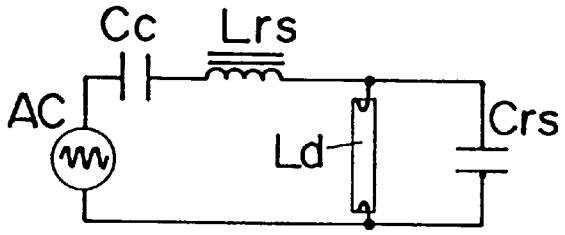
FIG. 25A (PRIOR ART)
FIGS. 25A and 25B illustrate the operation of the above prior circuit.
Figure 25B:
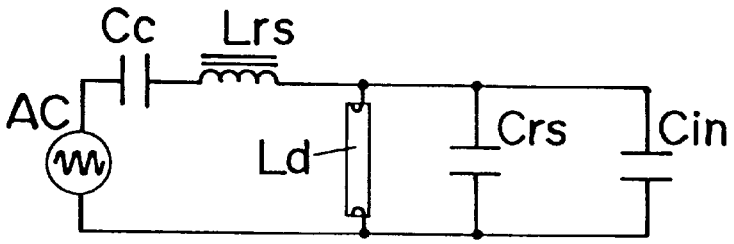
FIG. 25B (PRIOR ART)
Figure 26:
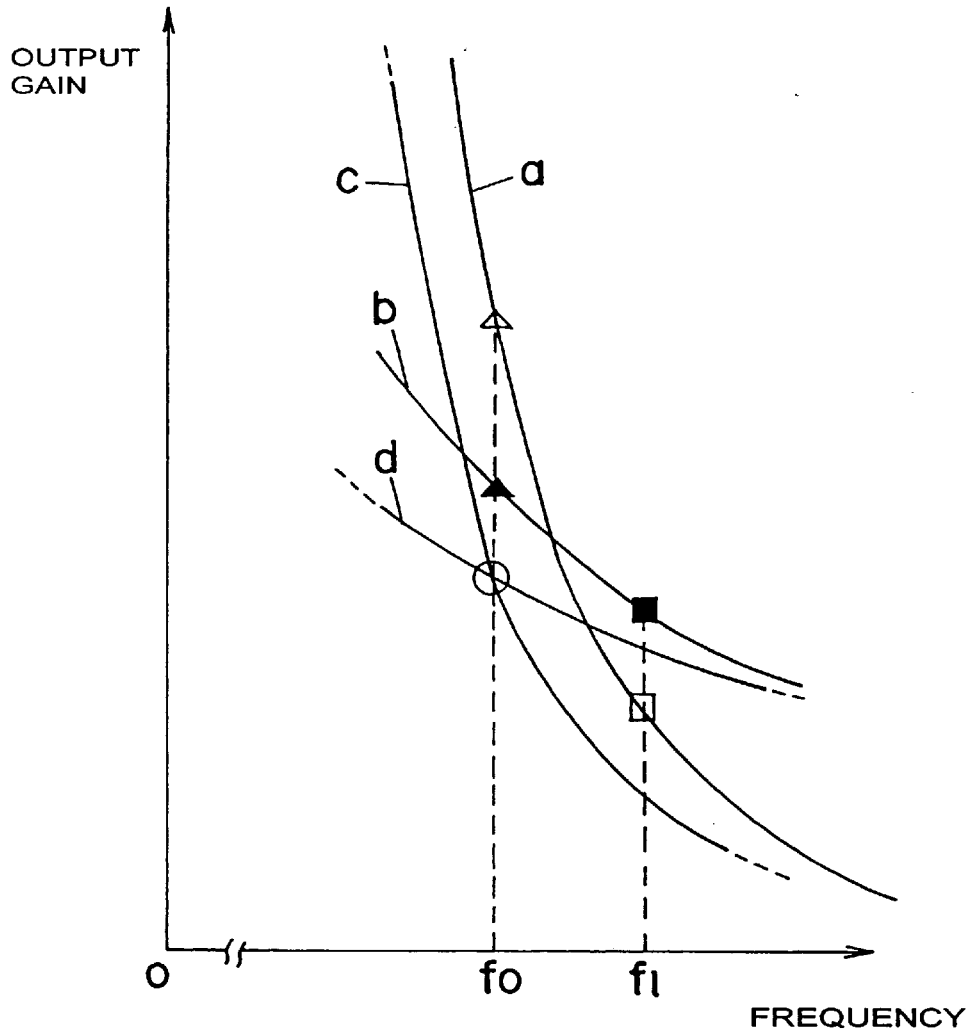
FIG. 26 (PRIOR ART)
FIG. 26 is a graph illustrating the operation of the above prior circuit.

FIG. 11 illustrates a discharge lamp driving circuit in accordance with a sixth embodiment of the present invention which is arranged to incorporate feedback circuit FB, mixer MX, and current sensor SI of the first embodiment into the prior lamp driving circuit of FIG. 21. With this configuration, it is enabled to control the switching elements Q1 and Q2 in order to give the lamp current of generally constant amplitude, thus enabling to suppress the crest factor even at the time of dimming the lamp. The other configurations and functions are identical to those of the first embodiment.

Seventh Embodiment

Figure 12:
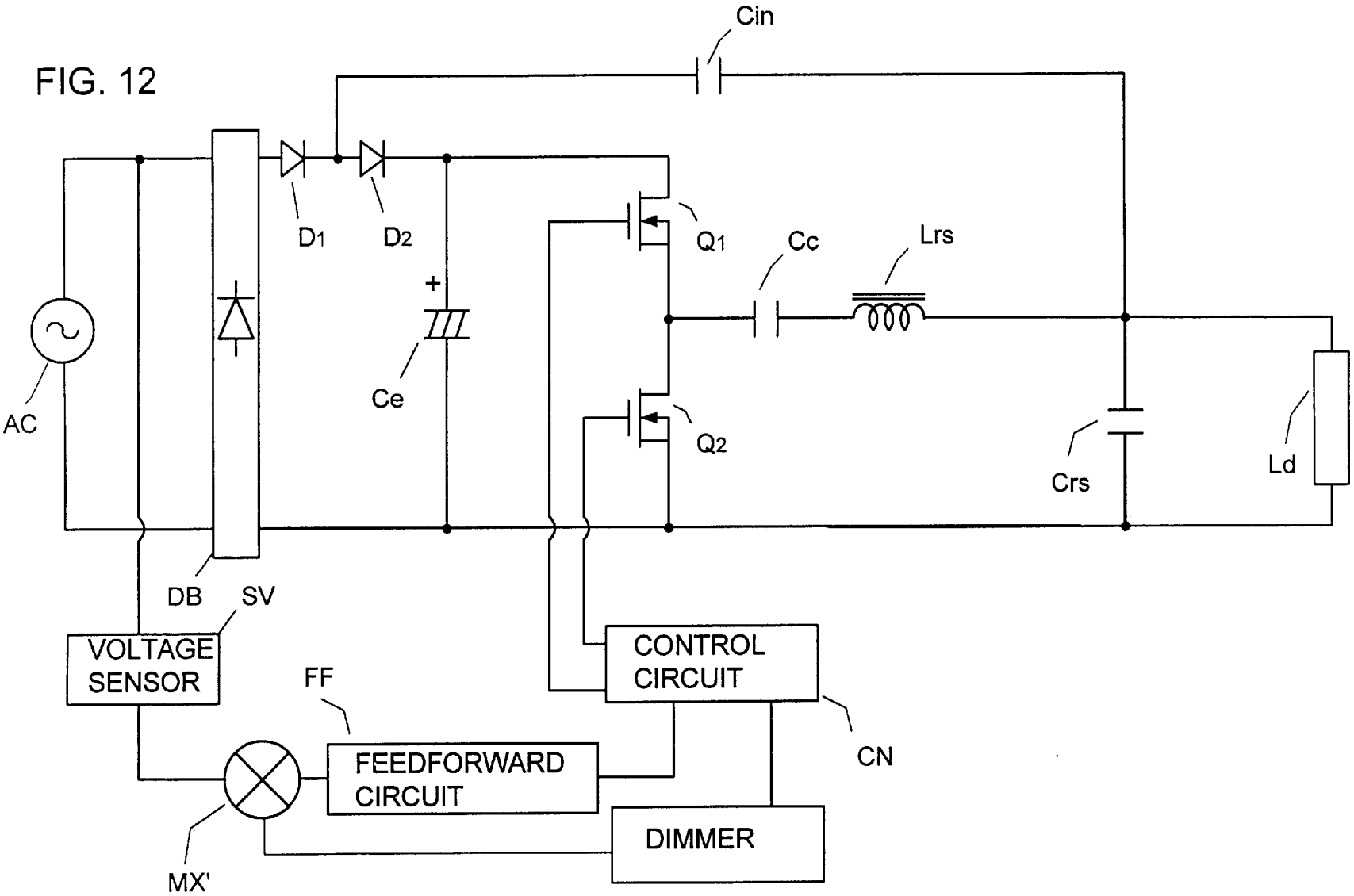
FIG. 12 is a circuit diagram of a discharge lamp driving circuit in accordance with a seventh embodiment of the present invention.

FIG. 12 illustrates a discharge lamp driving circuit in accordance with a seventh embodiment of the present invention which has an inverter of the same configuration as that of the sixth embodiment and includes input voltage sensor SV, mixer MX', and feed-forward circuit FF, instead of feedback circuit FB, mixer MX, and current sensor SI, for suppressing the crest factor at the time of dimming the lamp. The other configurations and functions are identical to those of the fifth embodiment.

Eighth Embodiment

Figure 13:
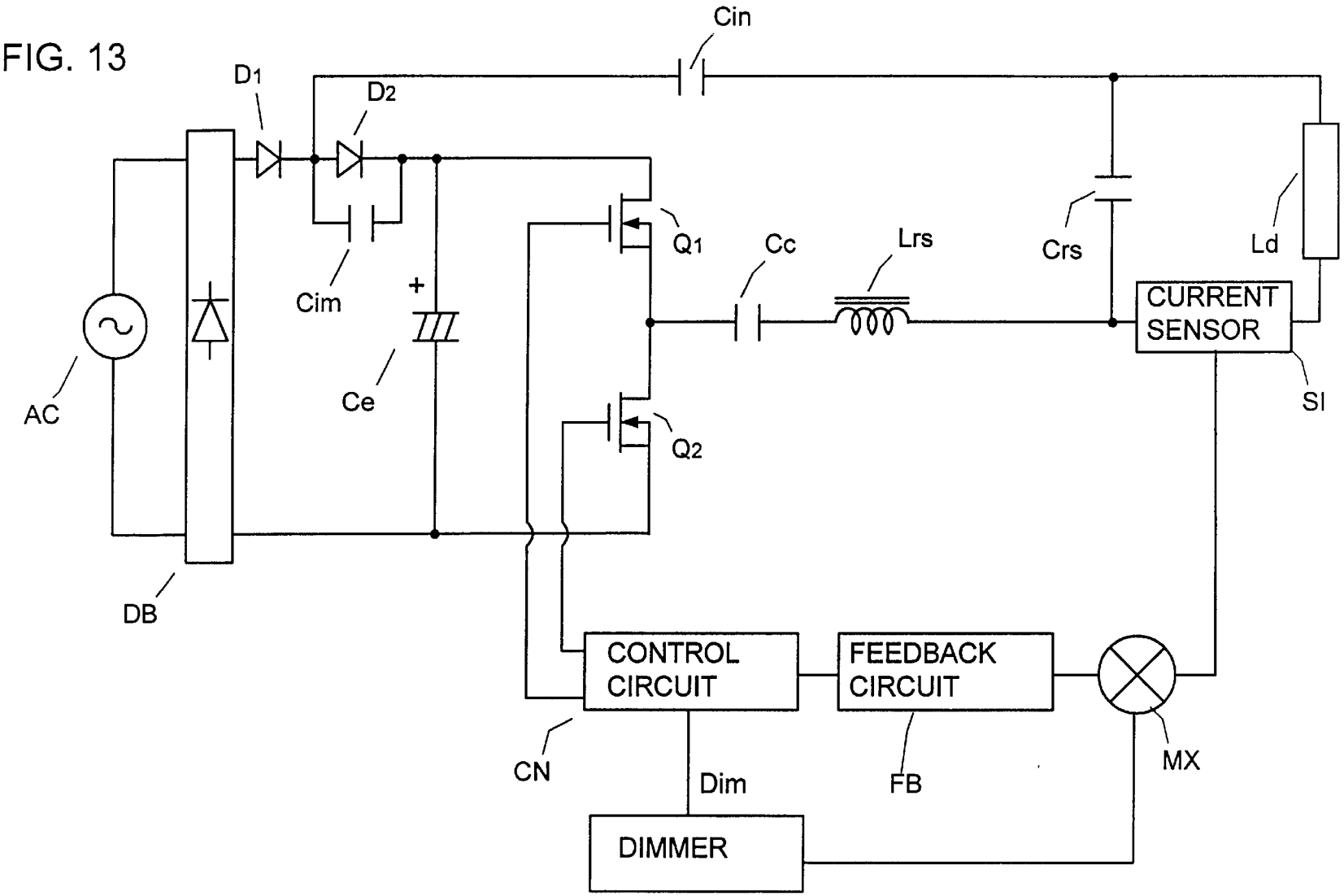
FIG. 13 is a circuit diagram of a discharge lamp driving circuit in accordance with an eighth embodiment of the present invention.
Figure 27:
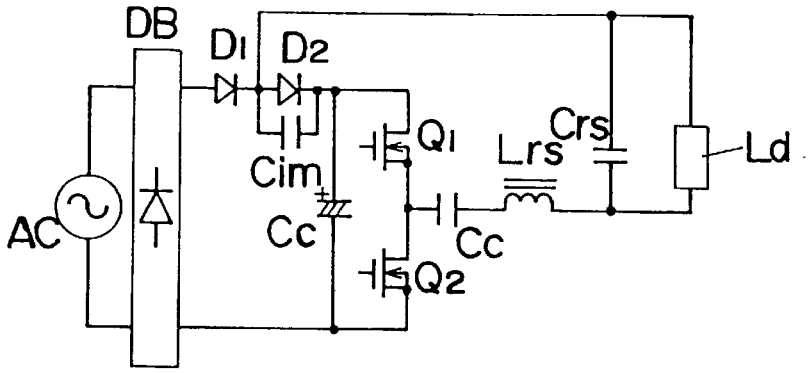
FIG. 27 (PRIOR ART)
FIG. 27 is a circuit diagram of another prior discharge lamp driving circuit.
Figure 28:
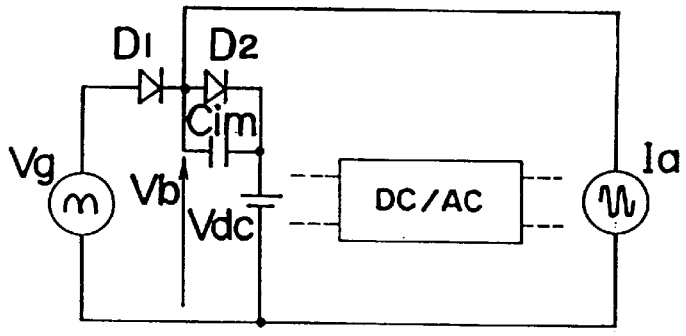
FIG. 28 (PRIOR ART)
FIG. 28 is a circuit diagram of an equivalent circuit of the circuit of FIG. 27.

FIG. 13 illustrates a discharge lamp driving circuit in accordance with an eighth embodiment of the present invention which is configured to incorporate feedback circuit FB, mixer MX, and current sensor SI of the first embodiment into the prior circuit of FIG. 27. With this circuit configuration, it is made to control switching elements Q1 and Q2 consistently in order to maintain the lamp current at a constant amplitude, assuring to suppress the crest factor at the time of dimming the lamp. The other configurations and functions are identical to those of the first embodiment.

Ninth Embodiment

Figure 14:
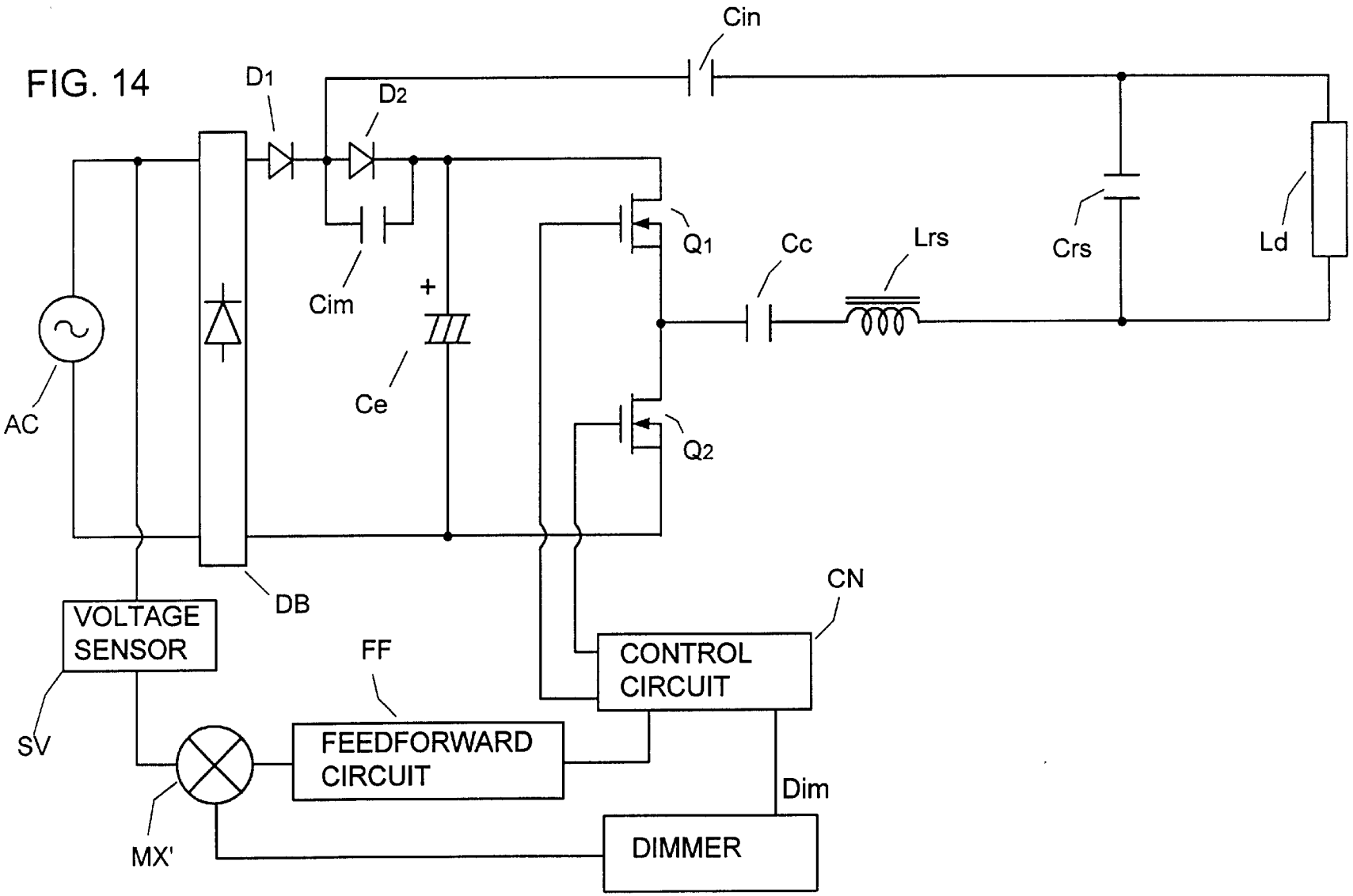
FIG. 14 is a circuit diagram of a discharge lamp driving circuit in accordance with a ninth embodiment of the present invention.

FIG. 14 illustrates a discharge lamp driving circuit in accordance with a ninth embodiment of the present invention. The circuit includes an inverter of the same configuration as that of the eighth embodiment and includes input voltage sensor SV, mixer MX', and feed-forward circuit FF, instead of feedback circuit FB, mixer MX, and current sensor SI, for suppressing the crest factor at the time of dimming the lamp. The other configurations and functions are identical to those of the fifth embodiment.

Tenth Embodiment

Figure 15:
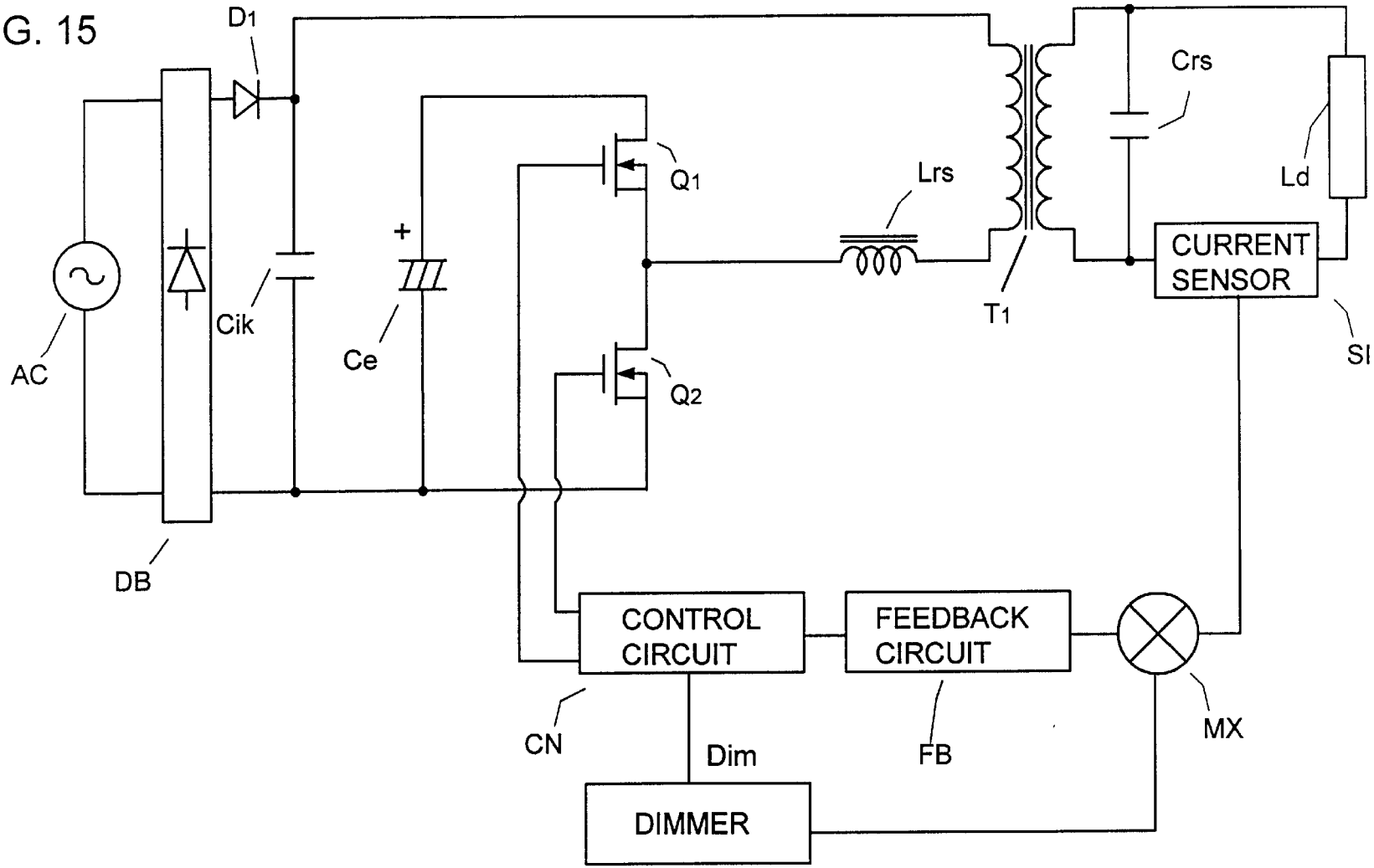
FIG. 15 is a circuit diagram of a discharge lamp driving circuit in accordance with a tenth embodiment of the present invention.

FIG. 15 illustrates a discharge lamp driving circuit in accordance with a tenth embodiment of the present invention in which a capacitor Cik is connected in series with a diode D1 across the output terminals of rectifier DB, and a series pair of switching elements Q1 and Q2 is connected across smoothing capacitor Ce. A primary winding of transformer T1 is connected in series with an inductor Lrs between the anode of diode D1 and a connection of switching elements Q1 and Q2. Smoothing capacitor Ce has its negative terminal side connected to negative terminal of rectifier DB. Transformer T1 has its secondary winding connected to capacitor Crs and discharge lamp Ld. Also in this embodiment, the resonant circuit operates at two resonant frequencies within one cycle of turning on and off switching elements Q1 and Q2. Capacitor Cik is provided to restrain input current distortion and high input power factor.

The circuit includes a set of feedback circuit FB, mixer MX, and current sensor SI as disclosed in the first embodiment. Also in this embodiment, switching elements Q1 and Q2 are controlled to provide a constant lamp current being fed to discharge lamp Ld and suppress the crest factor at the time of dimming the lamp. The other configurations and functions are identical to those of the first embodiment.

Eleventh Embodiment

Figure 16:
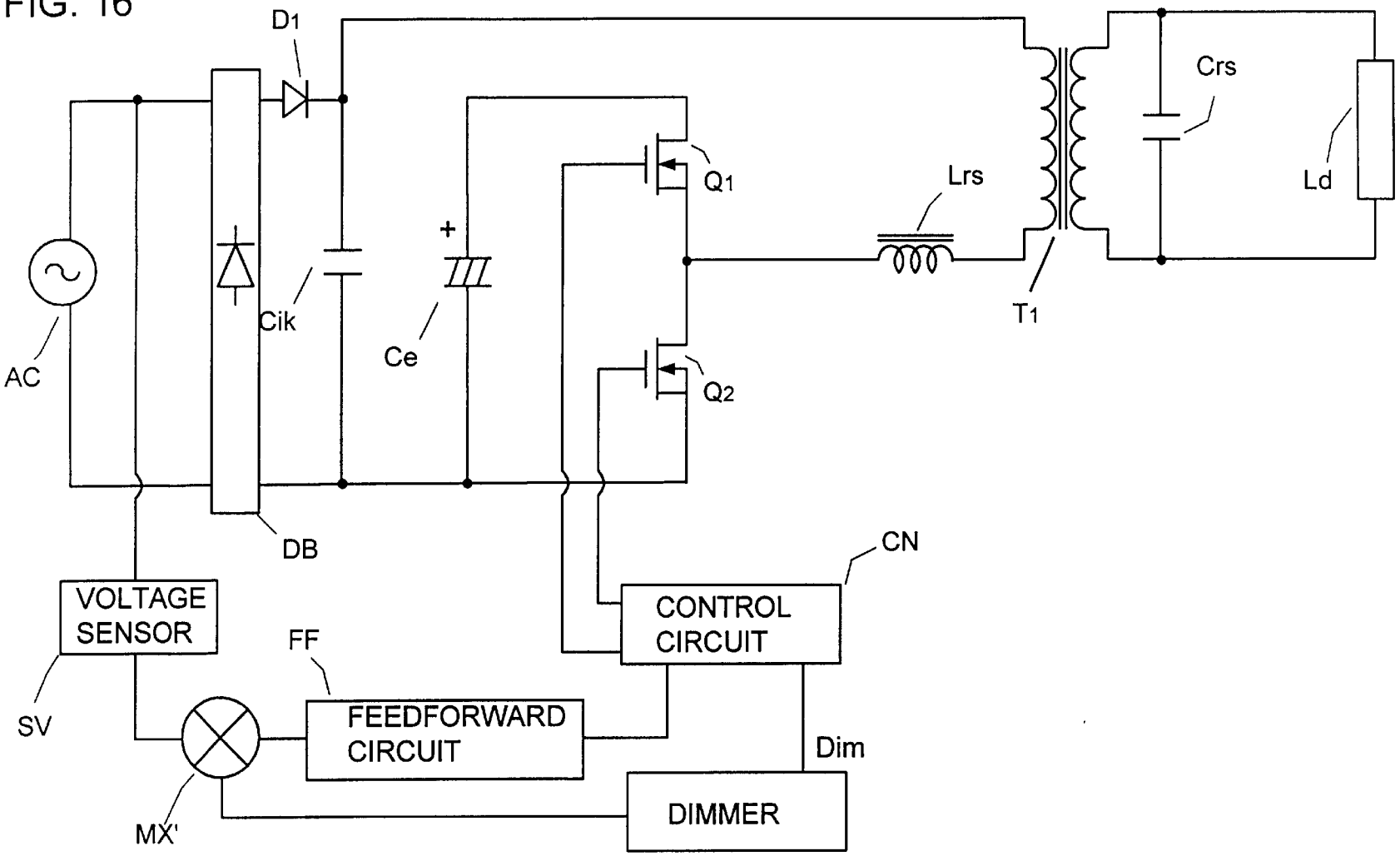
FIG. 16 is a circuit diagram of a discharge lamp driving circuit in accordance with an eleventh embodiment of the present invention.

FIG. 16 illustrates a discharge lamp driving circuit in accordance with an eleventh embodiment of the present invention. The circuit utilized the inverter of the same configuration as that of the tenth embodiment and includes input voltage sensor SV, mixer MX', and feed-forward circuit FF, instead of feedback circuit FB, mixer MX, and current sensor SI, for suppressing the crest factor at the time of dimming the lamp. The other configurations and functions are identical to those of the fifth embodiment.

Twelfth embodiment

The present embodiment is accomplished in consideration of an environmental temperature which influences upon the lamp characteristic. The discharge lamp is known to have temperature-dependent equivalent impedance. The increase in the equivalent impedance leads to an increased difference between the output gains obtained respectively at the two resonant modes appearing in one switching cycle of switching elements Q1 and Q2, thereby increasing the low frequency ripples in the lamp current being fed to the lamp Ld. With this result, stable discharge of the lamp is not expected and there appear undesired flickering, stripe shifting, and even extinction of lamp. This undesired effect becomes critical with increasing low frequency ripples in the lamp current as well as with lowering minimum amplitude of the lamp current. In view of this, the present embodiment is contemplated to reduce the undesired effect due to the low environmental temperature.

Figure 17:
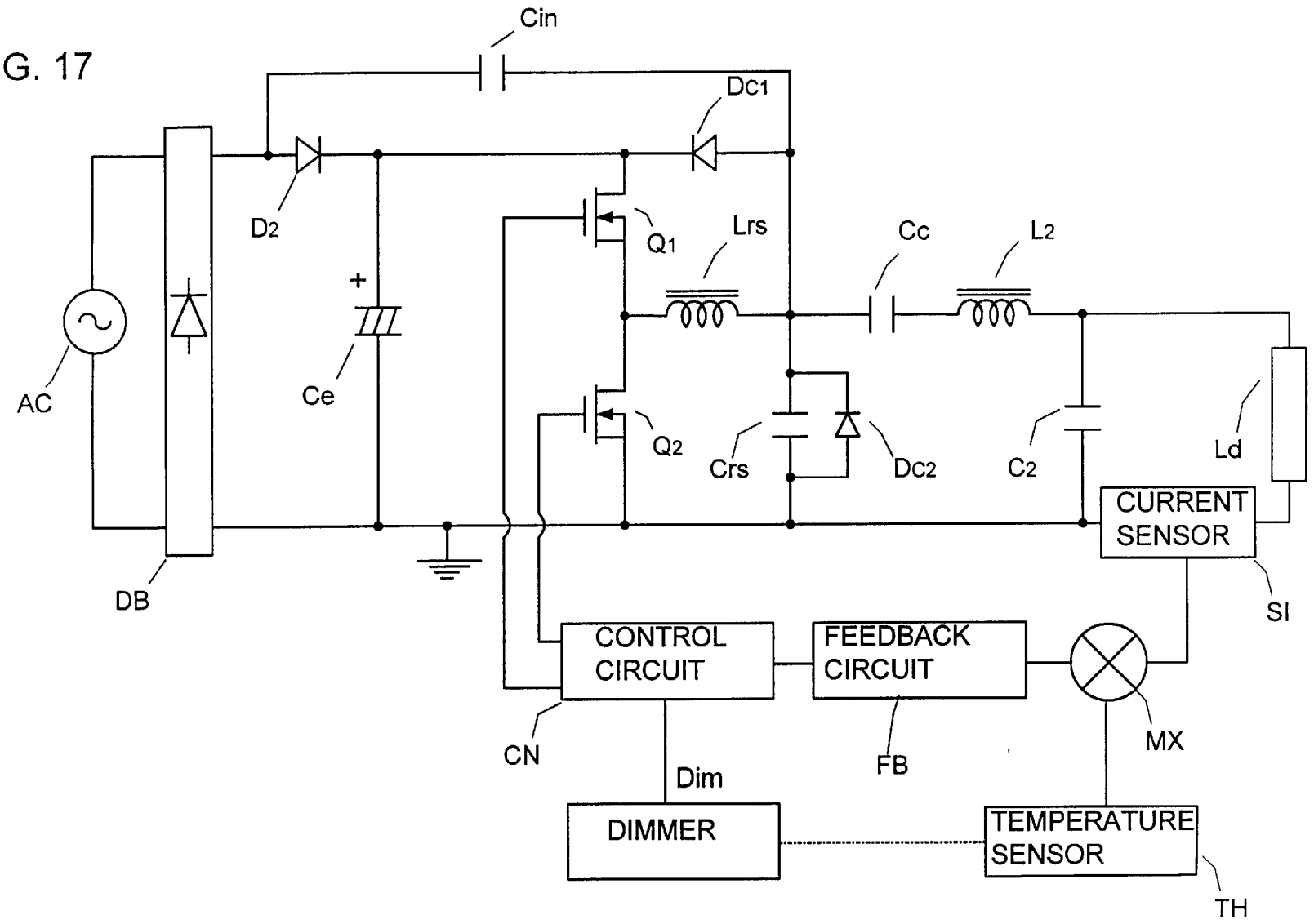
FIG. 17 is a circuit diagram of a discharge lamp driving circuit in accordance with a twelfth embodiment of the present invention.
Figure 18:
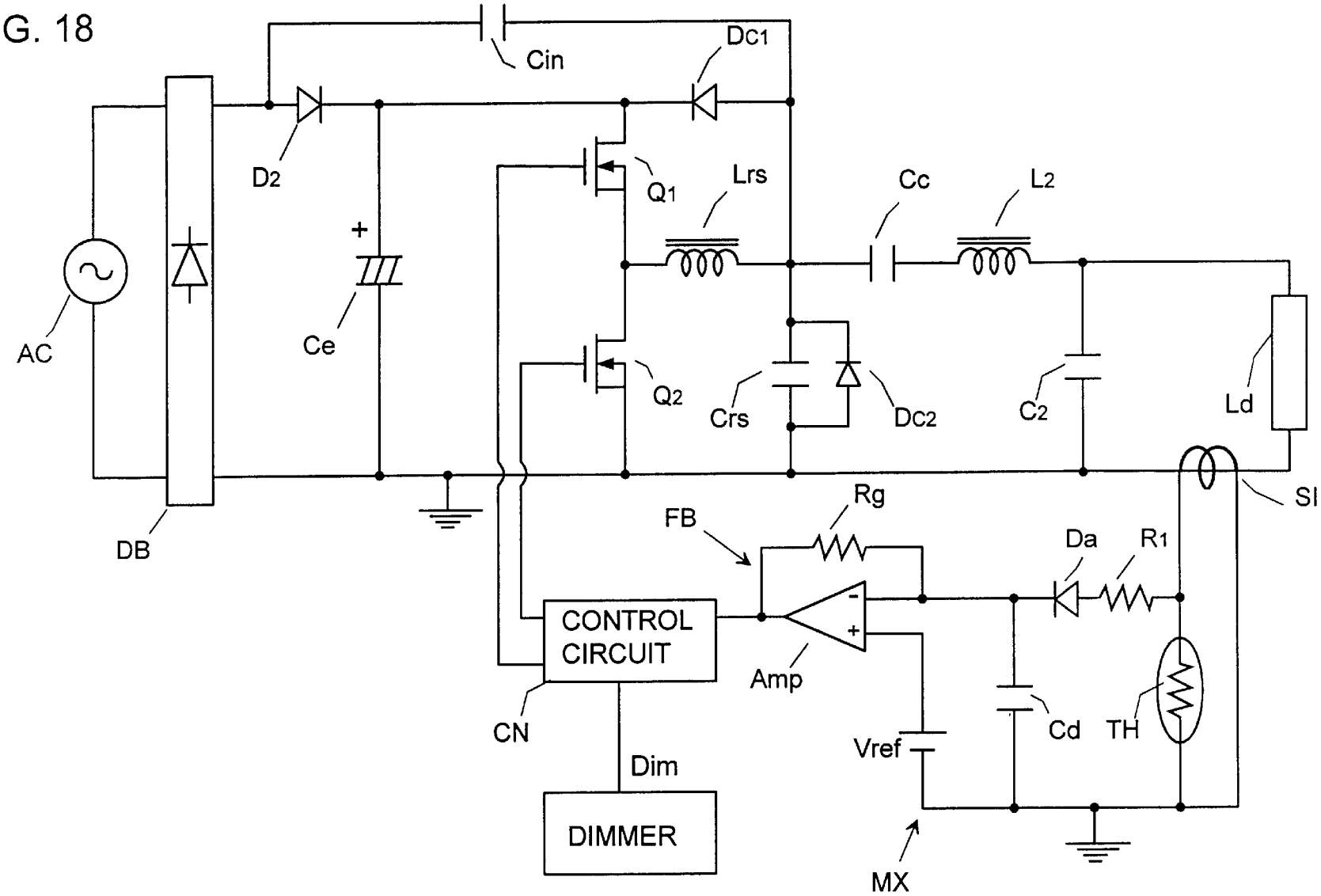
FIG. 18 is a circuit diagram illustrating the details of the circuit of FIG. 17.

As shown in FIG. 17, the circuit of this embodiment comprises, in addition to the circuit employed in the first embodiment of FIG. 1, a temperature sensor TH which detects the environmental temperature and provides an output voltage indicative thereof to mixer MX. In detail, temperature sensor TH comprises a thermistor of negative temperature coefficient connected across current sensor SI, as shown in FIG. 18. As the temperature is lowered, temperature sensor TH exhibits increased resistance so as to give the output voltage varying in an increased amplitude in response to the lamp current of a fixed amplitude detected at current sensor SI. Thus, error amplifier Amp can receives the voltage varying in an increased amplitude, i.e., having increased variation width in accordance with the lowering environmental temperature. Consequently, control circuit CN provides the control signal having a greater variation width with the lowering temperature, enabling to adjust the control signal in consistent with the varying lamp current at the low temperature for reducing the crest factor. The other configurations and functions are identical to those of first embodiment.

Thirteenth Embodiment

Figure 19:
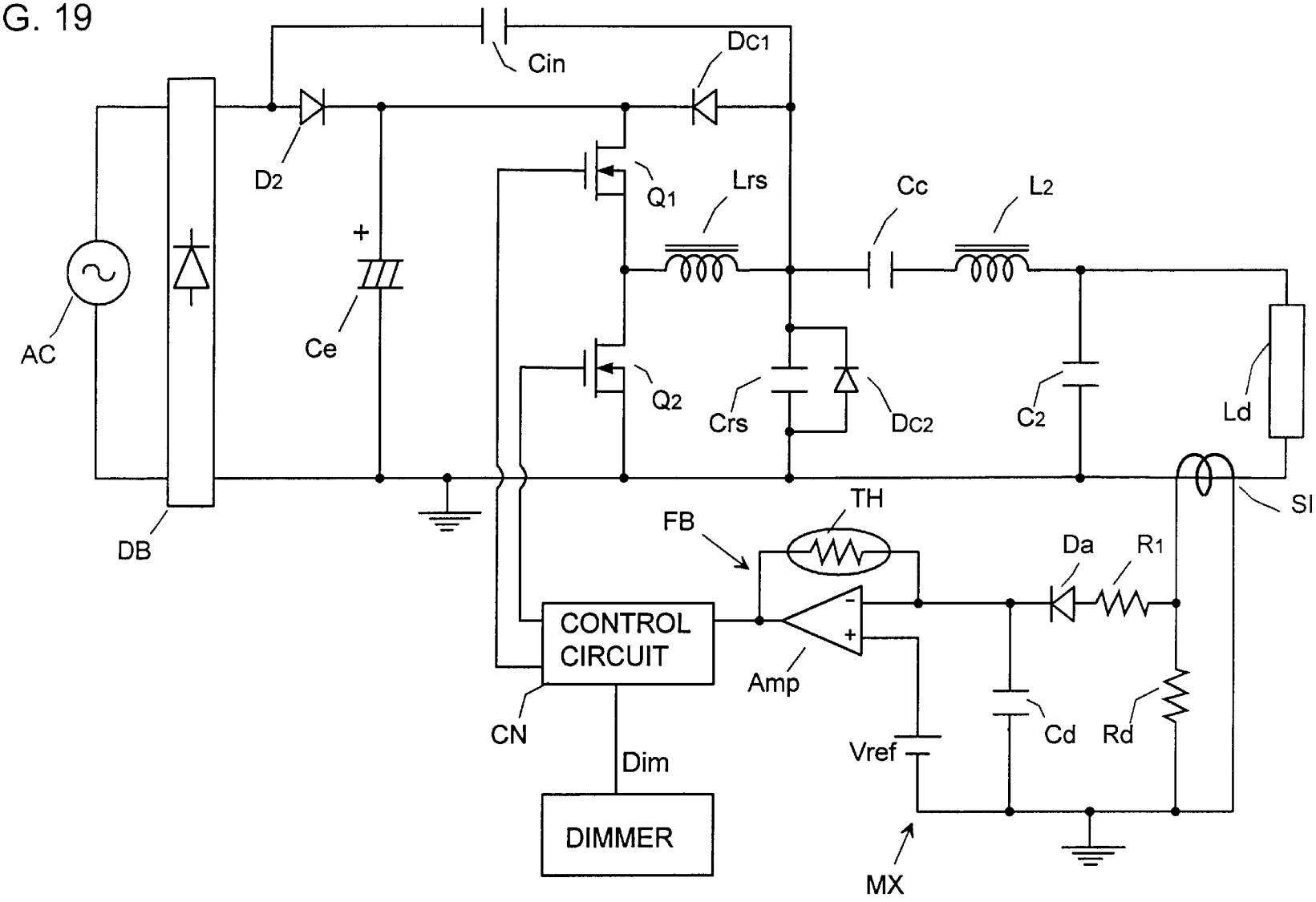
FIG. 19 is a circuit diagram of a discharge lamp driving circuit in accordance with a thirteenth embodiment of the present invention.

FIG. 19 illustrates a discharge lamp driving circuit in accordance with a thirteenth embodiment of the present invention in which temperature sensor SI of negative temperature coefficient thermistor is provided at a position to determine amplification factor of error amplifier Amp in substitution of resistor Rg in the circuit of FIG. 18. Lowering of the environmental temperature reduces a feedback amount of error amplifier so as to increase the amplification factor thereof, thereby increasing the modulation width of the control signal in relation to the variation width of the lamp current. The other configurations and functions are identical to those of first embodiment.

Fourteenth Embodiment

Figure 20:
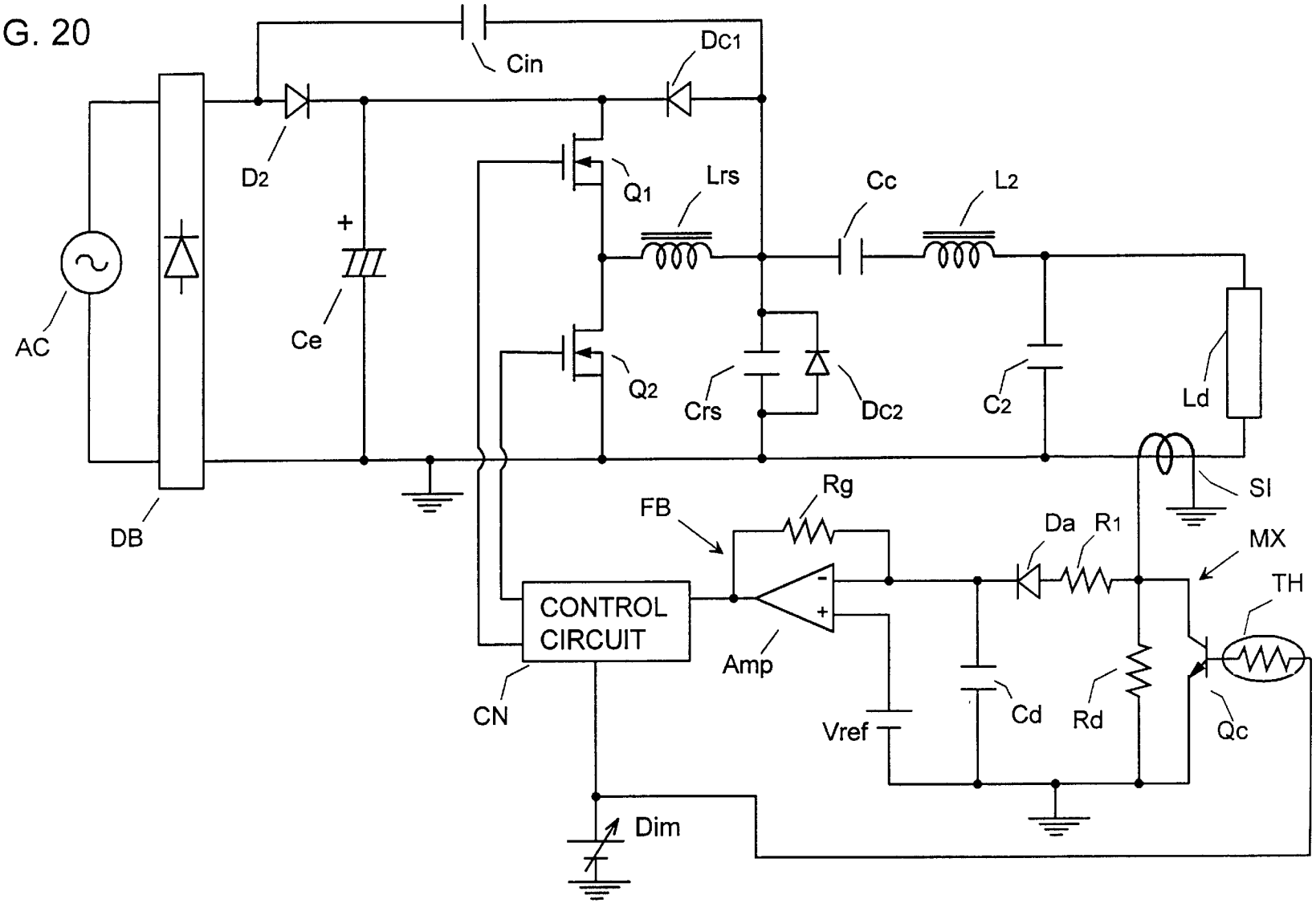
FIG. 20 is a circuit diagram of a discharge lamp driving circuit in accordance with a fourteenth embodiment of the present invention.

FIG. 20 illustrates a discharge lamp driving circuit in accordance with a fourteenth embodiment of the present invention which is contemplated to suppress the crest factor either at the time of dimming the lamp or at operating the lamp at the low environmental temperature. For this purpose, temperature sensor TH, i.e., thermistor of negative temperature coefficient is connected to the base of transistor Qc in substitution for resistor Rb in the circuit of FIG. 2.

When the dim level is selected to be high, transistor Qc exhibits increased equivalent resistance in its collector-emitter path, as discussed in the first embodiment. Also, when the environmental temperature is detected to be low, sensor TH exhibits increased resistance to reduce the base current to transistor Qc and therefore increase equivalent resistance in collector-emitter path of transistor Qc. As discussed in the first embodiment, the increase of the equivalent resistance in the collector-emitter path of transistor Qc causes the control signal to have increased modulation width in relation to the variation width of the lamp current, enabling to suppress the crest factor either at the time of dimming the lamp or at operating the lamp at the low temperature. The other configurations and functions are identical to those of the first embodiment.

The temperature sensor TH can be incorporated in any of the second to the eleventh embodiments in a manner as made in the twelfth or fourteenth embodiment in order to suppress the crest factor for stable lighting of the discharge lamp either when dimming the lamp or when operating at the low temperature.

What is claimed is:

1. A discharge lamp driving circuit comprising:

a rectifier for rectifying an AC voltage from an AC voltage source to give a DC voltage;

a smoothing capacitor for smoothing the DC voltage from said rectifier into a smoothed DC voltage;

an inverter including a switching element turning on and off at a high frequency for converting the smoothed DC voltage to provide a high frequency electric power;

a control circuit which provides a control signal for turning on and off said switching element to operate said inverter;

a load circuit including a discharge lamp and a resonant circuit connected to said inverter for applying the high frequency electric power from said inverter to said discharge lamp through said resonant circuit:

a capacitor connected to one end of said resonant circuit for varying the DC voltage of the output of the rectifier in accordance with a varying instantaneous value of said high frequency current or voltage appearing in the resonant circuit, said resonant circuit defining two resonance modes one including said capacitor and the other excluding said capacitor, and said resonant circuit changing said resonance modes from one to the other within one switching cycle of said switching element, said one resonance mode lasting over a varying period relative to the period of the other resonance mode in accordance with an instantaneous voltage level of said AC voltage source;

a ripple reducing circuit for providing a modulation signal which modulates said control signal to vary a timing of turning on and off said switching element within a certain range given to said control circuit in a direction of reducing ripples in an envelop of a lamp current being fed to said discharge lamp;

a conditional signal generating means which generates a conditional signal indicative of an external condition affecting the increase of the ripple of said lamp current; and said ripple reducing circuit having means which modifies said modulation signal in consideration of said conditional signal such that said modulation signal can modulate said control signal to vary said timing of turning on an off said switching element within said range for reducing the otherwise increasing ripple.

2. The discharge lamp driving circuit as set forth in claim 1, wherein said conditional signal generating means comprises a dimmer which provides a dimmer signal for dimming the lamp.

3. The discharge lamp driving circuit as set forth in claim 1, wherein said conditional signal generating means comprises a temperature sensor which detects an environmental temperature.

4. The discharge lamp driving circuit as set forth in claim 1, wherein said ripple reducing circuit comprises:

a detector for detecting at least one of an input voltage to said inverter and a load output from said inverter; and means for varying a factor of an input to an output of said detector according to said conditional signal.

5. The discharge lamp driving circuit as set forth in claim 4, wherein said detector detects at least one of the lamp current, a lamp voltage, a lamp power, and a resonant current of said resonant circuit as representative of said load output.

6. The discharge lamp driving circuit as set forth in claim 4, wherein said detector detects at least one of an input current to said rectifier, an input voltage to said rectifier, and an output voltage from said rectifier as said input voltage to said inverter.

7. The discharge lamp driving circuit as set forth in claim 1, wherein said ripple reducing circuit comprises:

an error amplifier which amplifies an error between the lamp current being detected and a reference voltage; and means for varying an amplification factor of said error amplifier in accordance with said conditional signal.

8. The discharge lamp driving circuit as set forth in claim 1, wherein said ripple reducing circuit comprises:

an error amplifier which amplifies an error between the lamp current being detected and a reference voltage; and means for varying said reference level in accordance with said conditional signal.

9. The discharge lamp driving circuit as set forth in claim 1, wherein said discharge lamp is a fluorescent lamp.

* * * * *